US010492659B2

(12) United States Patent
Shin et al.

(10) Patent No.: US 10,492,659 B2
(45) Date of Patent: Dec. 3, 2019

(54) DISH WASHING MACHINE AND METHOD OF CONTROLLING THE SAME

(71) Applicant: SAMSUNG ELECTRONICS CO., LTD., Suwon-si, Gyeonggi-do (KR)

(72) Inventors: Woo-Jin Shin, Suwon-si (KR); Hee Dong Roh, Suwon-si (KR); Jung Chan Ryu, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/344,038

(22) Filed: Nov. 4, 2016

(65) Prior Publication Data

US 2017/0135550 A1 May 18, 2017

(30) Foreign Application Priority Data

Nov. 13, 2015 (KR) ..... 10-2015-0159983

(51) Int. Cl.

| | |
|---|---|
| ***A47L 15/42*** | (2006.01) |
| ***A47L 15/46*** | (2006.01) |
| ***A47L 15/00*** | (2006.01) |
| *A47L 15/16* | (2006.01) |

(52) U.S. Cl.

CPC ..... *A47L 15/4208* (2013.01); *A47L 15/0049* (2013.01); *A47L 15/16* (2013.01); *A47L 15/4204* (2013.01); *A47L 15/4225* (2013.01); *A47L 15/4282* (2013.01); *A47L 2401/08* (2013.01); *A47L 2401/20* (2013.01); *A47L 2501/01* (2013.01); *A47L 2501/05* (2013.01); *A47L 2501/20* (2013.01)

(58) Field of Classification Search

CPC .. A47L 15/4225; A47L 15/0049; A47L 15/16; A47L 15/4204; A47L 2401/08; A47L 2401/20; A47L 2501/01; A47L 2501/05; A47L 2501/20; A47L 15/4208; A47L 15/4282

See application file for complete search history.

(56) References Cited

U.S. PATENT DOCUMENTS

| | | | | |
|---|---|---|---|---|
| 4,741,357 A * | 5/1988 | Battel | A47L 15/4244 137/387 |
| 8,899,918 B2 * | 12/2014 | Weber | F04D 9/003 415/206 |
| 9,872,597 B2 * | 1/2018 | Pers | A47L 15/0049 |
| 10,244,919 B2 * | 4/2019 | Pers | A47L 15/0023 |
| 2005/0005952 A1 * | 1/2005 | Bashark | A47L 15/0023 134/18 |
| 2006/0219262 A1 * | 10/2006 | Peterson | A47L 15/4244 134/18 |

(Continued)

FOREIGN PATENT DOCUMENTS

| | | | |
|---|---|---|---|
| EP | 2609845 B1 * | 6/2018 | A47L 15/0023 |
| EP | 3424399 A1 * | 1/2019 | A47L 15/4297 |

(Continued)

*Primary Examiner* — Alexander Markoff
(74) *Attorney, Agent, or Firm* — Staas & Halsey LLP

(57) ABSTRACT

It is an aspect of the present disclosure to provide a dish washing machine capable of actively responding to a problem when circulation of washing water is not smoothly performed by sequentially and selectively performing a bubble removal operation, a filter blockage removal operation, and a water supply operation, and a method of controlling the same.

15 Claims, 30 Drawing Sheets

(56) References Cited

U.S. PATENT DOCUMENTS

| | | | | |
|---|---|---|---|---|
| 2007/0163626 | A1* | 7/2007 | Klein | A47L 15/0049 134/56 D |
| 2013/0133699 | A1* | 5/2013 | Brandstetter | A47L 15/0049 134/25.2 |
| 2016/0316990 | A1* | 11/2016 | Ryu | A47L 15/16 |
| 2017/0135550 | A1* | 5/2017 | Shin | A47L 15/0049 |

FOREIGN PATENT DOCUMENTS

| | | | | |
|---|---|---|---|---|
| JP | 2005052176 | A * | 3/2005 | A47L 15/0023 |
| WO | WO-2007099112 | A1 * | 9/2007 | D06F 39/06 |
| WO | WO-2015102287 | A1 * | 7/2015 | A47L 15/16 |

* cited by examiner

DISH WASHING MACHINE AND METHOD OF CONTROLLING THE SAME

CROSS-REFERENCE TO RELATED APPLICATION

This application claims the benefit of Korean Patent Application No. 10-2015-0159983, filed on Nov. 13, 2015 in the Korean Intellectual Property Office, the disclosure of which is incorporated herein by reference.

BACKGROUND

1. Field

Embodiments of the present disclosure relate to a dish washing machine capable of overcoming a limitation by detecting a cause thereof when circulation of washing water is not smoothly performed.

2. Description of the Related Art

A dish washing machine is a home appliance which includes a body including a washing tub therein, a basket for accommodating dishes, a sump for storing washing water, a nozzle for spraying the washing water, and a circulation pump for supplying the washing water in the sump to the nozzle, and washes dishes by spraying washing water onto the dishes at a high pressure.

A certain level or more of washing water should flow into and be circulated through a circulation pump for a dish washing machine to smoothly perform operations such as washing, rinsing, and the like. However, when a problem occurs due to a variety of reasons such as an occurrence of bubbles, a filter blockage, or the like during a process in which washing water flows into the circulation pump, a circulation amount of the washing water is notably reduced.

Accordingly, when a phenomenon in which the circulation amount of the washing water is reduced occurs, it is necessary to detect a cause thereof and perform a proper operation for resolving the same.

SUMMARY

Therefore, it is an aspect of the present disclosure to provide a dish washing machine capable of actively responding to a problem when circulation of washing water is not smoothly performed by sequentially and selectively performing a bubble removal operation, a filter blockage removal operation, and a water supply operation, and a method of controlling the same.

It is another aspect of the present disclosure to provide a dish washing machine which not only simply stops a circulation pump and stands by while removing bubbles but is also able to reduce a time used for removing the bubbles by directly jetting washing water onto surfaces of the bubbles.

Additional aspects of the present disclosure will be set forth in part in the description which follows and, in part, will be obvious from the description, or may be learned by practice of the present disclosure.

In accordance with one aspect of the present disclosure, a dish washing machine is configured to comprise: a washing tub; a sump installed at a bottom of the washing tub and configured to store washing water; a circulation pump configured to pump and circulate the washing water stored in the sump; at least one nozzle configured to jet the washing water pumped by the circulation pump into the washing tub; a filter configured to filter foreign material included in the washing water; a detector configured to detect a failure of the circulation pump; and a controller configured to perform one of a bubble removal operation for removing bubbles generated in the washing tub, a filter blockage removal operation for removing a blockage of the filter, and a water supplementation operation for additionally supplying water to the washing tub as a first operation when the failure of the circulation pump is detected, to perform one of the two remaining operations as a second operation when the failure of the circulation pump is detected even after the first operation is finished, and to perform the one remaining operation as a third operation when the failure of the circulation pump is detected even after the second operation is finished.

The detector may be configured to determine that the failure occurs at the circulation pump when a change in power consumption of the circulation pump is detected to be a preset reference value or more.

The controller may be configured to control revolutions per minute (RPM) of the circulation pump to be a first speed and jets the washing water onto the bubbles through the nozzle to perform the bubble removal operation.

The first speed may be less than a speed at which the washing water jetted from the nozzle arrives at an upper basket disposed above the nozzle, and be a minimum speed for rotating the nozzle or more.

The nozzle may be an intermediate nozzle positioned between the upper basket and a lower basket disposed at a lower part of the washing tub, and wherein the intermediate nozzle jets the washing water onto bubbles positioned at the bottom of the washing tub.

The first speed may be selected within a range of 1400 RPM to 1600 RPM.

The controller stops rotation of the circulation pump to perform the bubble removal operation.

The at least one nozzle may be configured to comprise: an intermediate nozzle positioned between an upper basket disposed at an upper part of the washing tub and a lower basket disposed at a lower part of the washing tub; and a lower nozzle positioned below the lower basket.

The controller may be configured to slow start the circulation pump when a preset time passes after the rotation of the circulation pump is stopped.

The controller may be configured to control the intermediate nozzle and the lower nozzle to sequentially jet the washing water after slow starting the circulation pump.

The dish washing machine may be configured to further comprise a water supply valve configured to adjust an amount of washing water supplied into the washing tub.

The controller may be configured to add a preset amount of washing water to the washing tub by controlling the water supply valve to perform the water supplementation operation.

The controller may be configured to drain all washing water filled into the washing tub and supplies a preset amount of washing water to the washing tub by controlling the water supply valve to perform the water supplementation operation.

The controller may be configured to perform the bubble removal operation as the first operation, performs the filter blockage removal operation as the second operation, and performs the water supplementation operation as the third operation.

The controller may be configured to perform the water supplementation operation again when the failure of the circulation pump is detected even after the water supplementation operation is finished.

In accordance with another aspect of the present disclosure, a dish washing machine is configured to comprise: a washing tub; a sump installed at a bottom of the washing tub and configured to store washing water; a circulation pump configured to pump and circulate the washing water stored in the sump; at least one nozzle configured to jet the washing water pumped by the circulation pump into the washing tub; and a detector configured to detect a failure of the circulation pump, wherein when the failure of the circulation pump is detected, the washing water is jetted onto bubbles by controlling RPM of the circulation pump to be a first speed, and wherein the first speed is less than a speed at which the washing water jetted from the nozzle arrives at an upper basket disposed above the nozzle, and is a minimum speed for rotating the nozzle or more.

The nozzle may be an intermediate nozzle positioned between the upper basket and a lower basket disposed at a lower part of the washing tub, and wherein the intermediate nozzle jets the washing water onto bubbles positioned at the bottom of the washing tub.

The first speed may be selected within a range of 1400 RPM to 1600 RPM.

In accordance with another aspect of the present disclosure, a method of controlling a dish washing machine comprising a washing tub, a sump installed at a bottom of the washing tub and configured to store washing water, a circulation pump configured to pump and circulate the washing water stored in the sump, at least one nozzle configured to jet the washing water pumped by the circulation pump into the washing tub, and a filter configured to filter foreign material included in the washing water, the method is configured to comprise: monitoring whether a failure occurs based on a change in power consumption of the circulation pump; performing one of a bubble removal operation for removing bubbles generated in the washing tub, a filter blockage removal operation for removing a blockage of the filter, and a water supplementation operation for additionally supplying water to the washing tub as a first operation when the failure of the circulation pump is detected; performing one of the two remaining operations as a second operation when the failure of the circulation pump is detected even after the first operation is finished; and performing the one remaining operation as a third operation when the failure of the circulation pump is detected even after the second operation is finished.

The monitoring of whether the failure occurs based on the change in the power consumption of the circulation pump may be configured to comprise determining that the failure occurs at the circulation pump when the change in the power consumption of the circulation pump is detected to be a preset reference value or more.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Hereinafter, a dish washing machine and a method of controlling the same in accordance with one embodiment of the present disclosure will be described in detail with reference to the attached drawings.

First, a structure of the dish washing machine in accordance with one embodiment of the present disclosure will be described, and then operations of the dish washing machine will be described based on the same.

Figure 1:
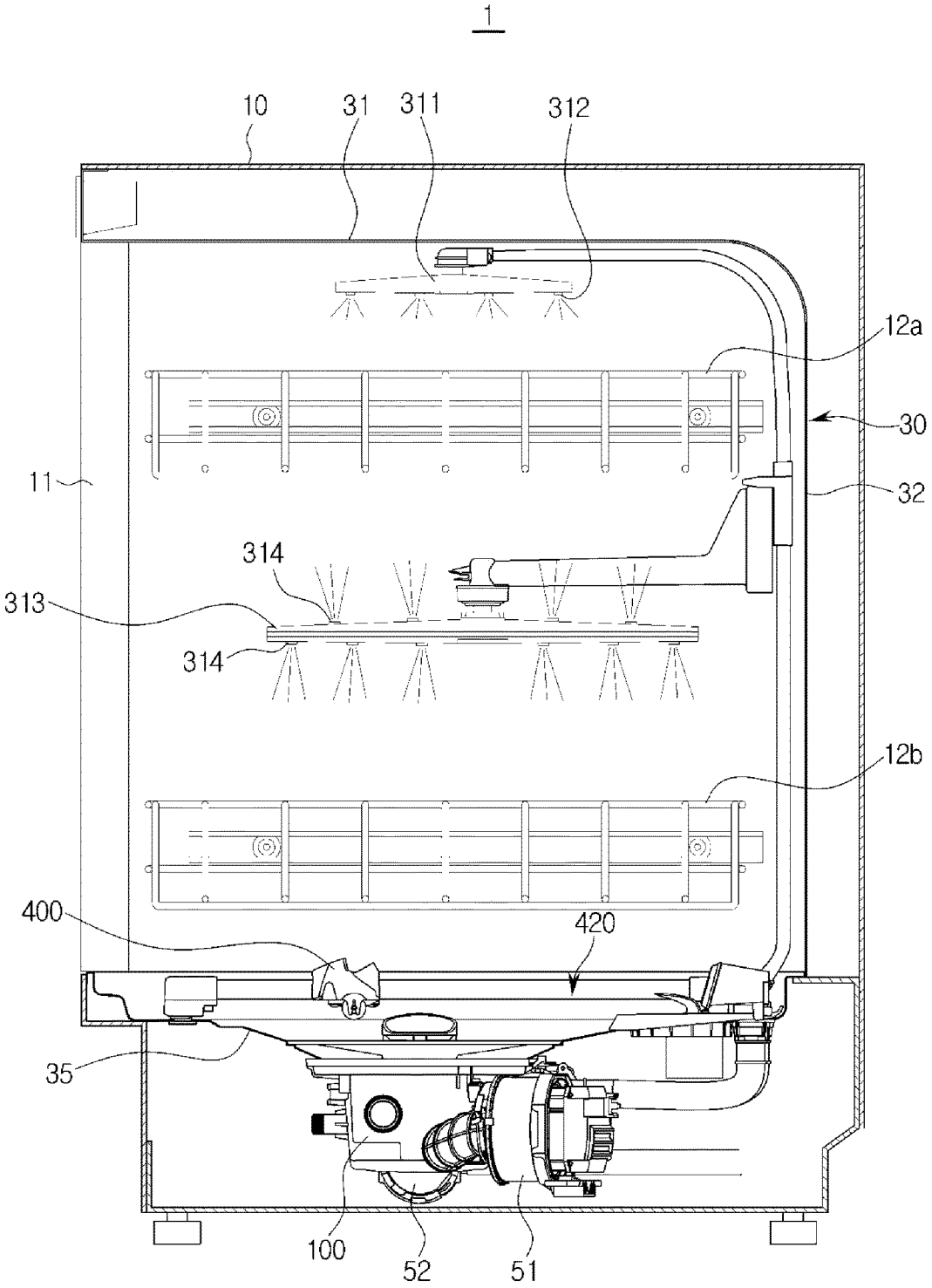
FIG. 1 is a side cross-sectional view illustrating an example of a dish washing machine in accordance with one embodiment of the present disclosure.
Figure 2:
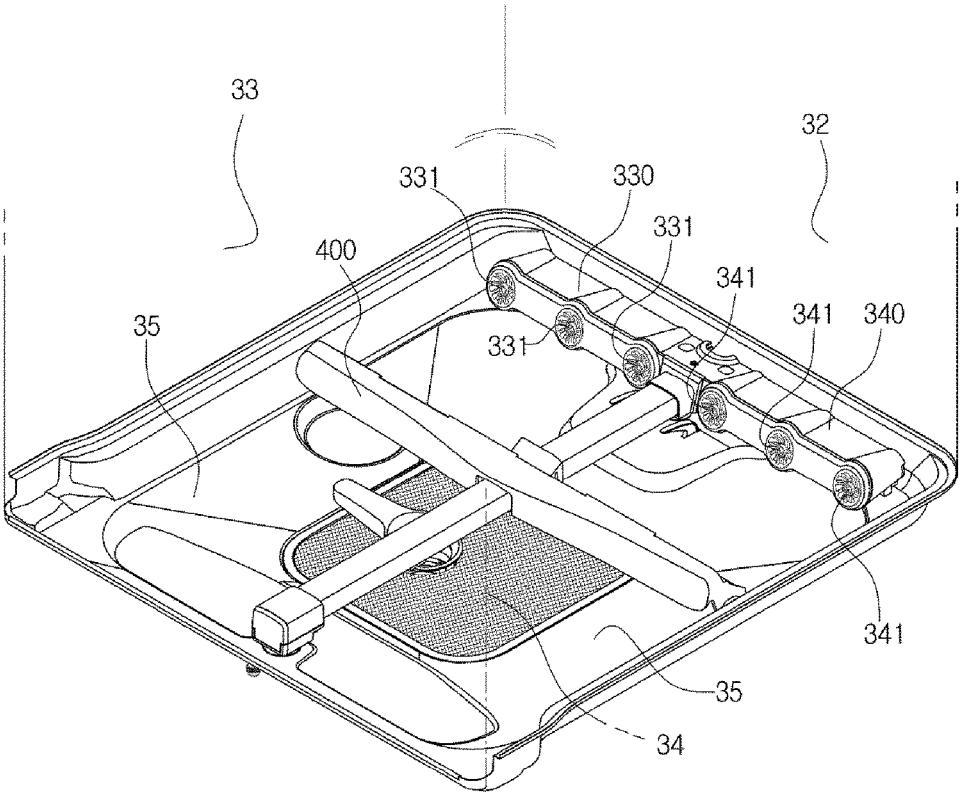
FIG. 2 is a bottom view of the dish washing machine in accordance with the example of FIG. 1.

FIG. 1 is a side cross-sectional view illustrating an example of a dish washing machine in accordance with one embodiment of the present disclosure. FIG. 2 is a bottom view of the dish washing machine in accordance with the example of FIG. 1.

Referring to FIGS. 1 and 2, a dish washing machine 1 may include a body 10 which forms an exterior thereof, a washing tub 30 provided in the body 10, baskets 12*a* and 12*b* provided in the washing tub 30 to store dishes, nozzles 311, 313, 330, and 340 which jet washing water, a sump 100 which stores washing water, a circulation pump 51 which pumps and supplies the washing water of the sump 100 to the nozzles 311, 313, 330, and 340, a drain pump 52 which discharges the washing water of the sump 100 with foreign material from the body 10 to the outside, a vane 400 which deflects washing water toward dishes while moving in the washing tub 30, and a driving device 420 which drives the vane 400.

The washing tub 30 has a shape with an open front to store dishes, and includes a top wall 31, a rear wall 32, a left wall 33, a right wall 34, and a bottom plate 35. A front opening of the washing tub 30 is opened and closed by a door 11.

The baskets 12*a* and 12*b* may be configured as wire racks formed of wires such that washing water is not accumulated and may pass therethrough. The baskets 12*a* and 12*b* may be detachably provided in the washing tub 30. The baskets 12*a* and 12*b* may include an upper basket 12*a* disposed at an upper portion of the washing tub 30 and a lower basket 12*b* disposed at a lower portion of the washing tub 30.

The circulation pump 51 may circulate washing water using a universal motor including a field coil and an armature, a brushless direct current (BLDC) motor including a permanent magnet and an electromagnet, or the like.

In the embodiment, the circulation pump 51 using a BLDC motor with controllable revolutions per minute (RPM) will be described as an example.

The nozzles 311, 313, 330, and 340 jet washing water at a high pressure to wash dishes. The nozzles 311, 313, 330, and 340 may include an upper nozzle 311 provided at the upper portion of the washing tub 30, an intermediate nozzle 313 provided at the center of the washing tub 30, and lower nozzles 330 and 340 provided at the lower portion of the washing tub 30.

The upper nozzle 311 may be provided above the upper basket 12*a* and may jet washing water downward while rotating due to water pressure of the jetted washing water. Accordingly, the upper nozzle 311 may directly jet washing water toward dishes stored in the upper basket 12*a*. For this, a plurality of jet holes 312 which jet washing water are provided on the bottom of the upper nozzle 311.

The intermediate nozzle 313 may be provided between the upper basket 12*a* and the lower basket 12*b* and may vertically jet washing water while rotating due to water pressure of the jetted washing water. Accordingly, the intermediate nozzle 313 may directly jet washing water toward dishes stored in the upper basket 12*a* and the lower basket 12*b*. For this, a plurality of jet holes 314 which jet washing water are provided on the top and bottom of the intermediate nozzle 313.

The lower nozzles 330 and 340 may be provided so as not to move unlike the upper nozzle 311 and the intermediate nozzle 313 and may be fixed to one side of the washing tub 30. The lower nozzles 330 and 340 may be approximately adjacently disposed to the rear wall 32 of the washing tub 30 and may jet washing water toward a front of the washing tub 30. Accordingly, the washing water jetted from the lower nozzles 330 and 340 may not directly face the dishes.

The washing water jetted from the lower nozzles 330 and 340 may be deflected by the vane 400 toward the dishes. The lower nozzles 330 and 340 are disposed below the lower basket 12*b*, and the vane 400 deflects the washing water jetted from the lower nozzles 330 and 340 upward. That is, the washing water jetted from the lower nozzles 330 and 340 may be deflected by the vane 400 toward the dishes stored in the lower basket 12*b*.

The lower nozzles 330 and 340 include a plurality of jet holes 331 and 341 arranged in a left and right direction of the washing tub 30, respectively. The plurality of jet holes 331 and 341 jet washing water forward.

The vane 400 may extend to be long in the left and right direction of the washing tub 30 such that all of the washing water jetted from the plurality of jet holes 331 and 341 of the lower nozzles 330 and 340 is deflected. That is, one longitudinal end of the vane 400 may be provided to be adjacent to the left wall 33 of the washing tub 30 and the other longitudinal end of the vane 400 may be provided to be adjacent to the right wall 34.

The vane 400 may linearly reciprocate along a jetting direction of the washing water jetted from the lower nozzles 330 and 340. That is, the vane 400 changes the jetting direction of the washing water jetted from the lower nozzles 330 and 340 while moving between a first position adjacent to the door 11 and a second position adjacent to the lower nozzles 330 and 340 and linearly reciprocates forward and backward in the washing tub 30.

Here, the second position is a position which minimizes a gap between the vane 400 and the lower nozzles 330 and 340. The first position is a position at which the vane 400 is adjacent to the door 11 and the gap between the vane 400 and the lower nozzles 330 and 340 is maximized, and detected by using a movement time from the second position as a position of the vane 400.

Accordingly, a linear type jet structure including the lower nozzles 330 and 340 and the vane 400 may jet washing water toward the whole area of the washing tub 30 to wash dishes without a blind spot.

The lower nozzles 330 and 340 may include a left lower nozzle 330 disposed on a left side of the washing tub 30 and a right lower nozzle 340 disposed on a right side of the washing tub 30.

The upper nozzle 311, the intermediate nozzle 313, and the lower nozzles 330 and 340 may independently jet washing water, and the left lower nozzle 330 and the right lower nozzle 340 may independently jet washing water.

Washing water jetted from the left lower nozzle 330 may be deflected by the vane 400 only to a left area of the washing tub 30, and washing water jetted from the right lower nozzle 340 may be deflected by the vane 400 only to a right area of the washing tub 30.

Accordingly, the dish washing machine 1 may independently and separately wash the left side and the right side of the washing tub 30.

Meanwhile, in the example described above, an example in which washing is performed while dividing the washing tub 30 into the left side and the right side has been described. However, embodiments of the dish washing machine 1 are not limited thereto and it is possible to further subdivide washing areas to perform separate washing as necessary.

Also, the structure of the dish washing machine 1 described above is merely an example, the number and positions of the baskets, the number and positions of the nozzles, the structure of the nozzles, and the like are not limited the example described above, and the structure of the dish washing machine 1 may be embodied differently from the example described above.

Figure 3:
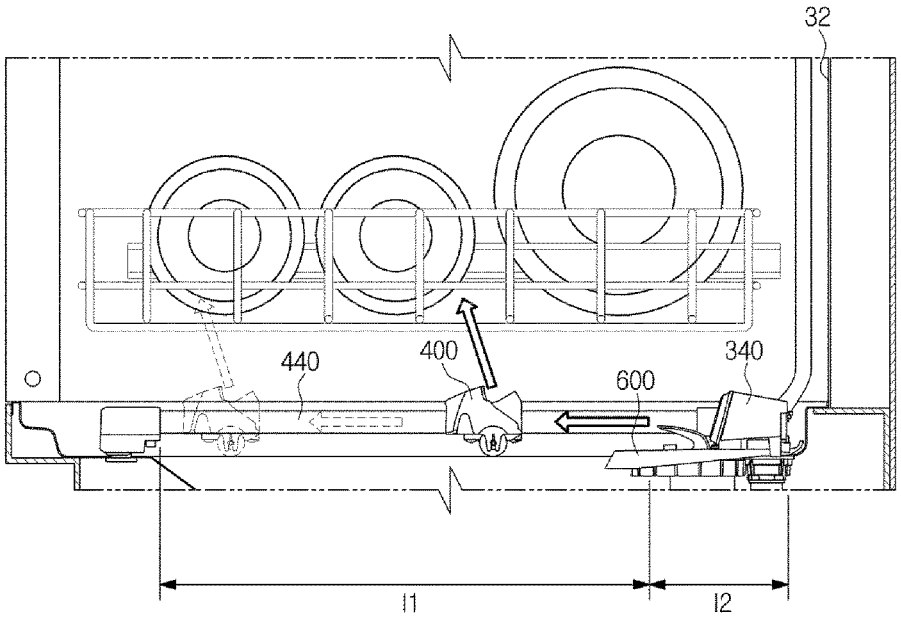
FIG. 3 is a view illustrating operations of the vane deflecting washing water in a vane movement section of the dish washing machine in accordance with one embodiment of the present disclosure.
Figure 4:
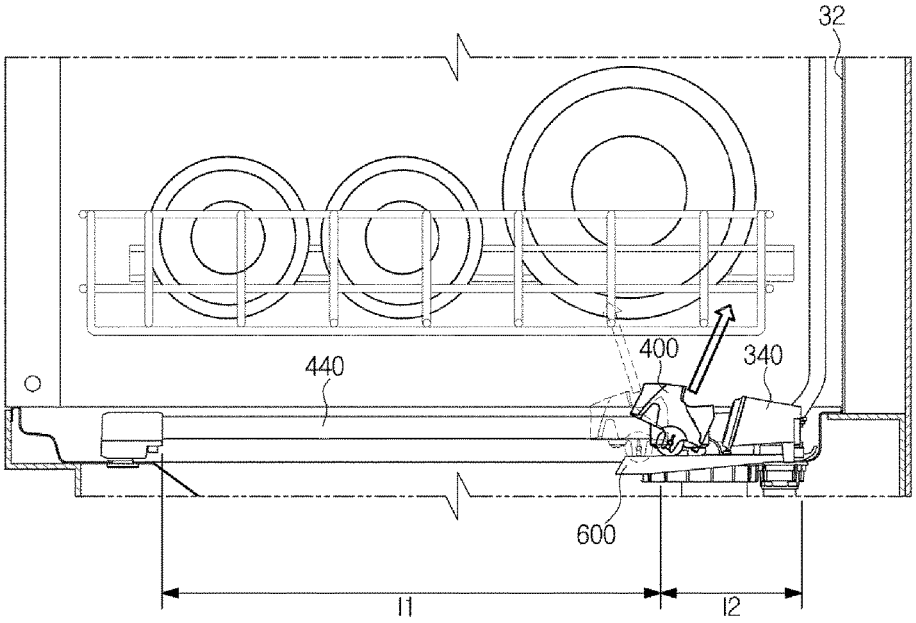
FIG. 4 is a view illustrating operations of the vane deflecting washing water in a vane non-movement section of the dish washing machine in accordance with one embodiment of the present disclosure.

FIG. 3 is a view illustrating operations of the vane deflecting washing water in a vane movement section of the dish washing machine in accordance with one embodiment of the present disclosure. FIG. 4 is a view illustrating operations of the vane deflecting washing water in a vane non-movement section of the dish washing machine in accordance with one embodiment of the present disclosure.

The washing water jetted from the lower nozzles 330 and 340 may be deflected by the vane 400 toward dishes. Since the lower nozzles 330 and 340 jet washing water in an approximately horizontal direction, the lower nozzles 330 and 340 and the vane 400 are positioned to be approximately horizontal to each other. Accordingly, the vane 400 may not move in an area in which the lower nozzles 330 and 340 are arranged.

As shown in FIG. 3, the dish washing machine 1 includes a vane movement section 11 in which the vane 400 may move and a vane non-movement section 12 in which the vane 400 may not move.

The vane 400 of the dish washing machine 1 in accordance with one embodiment of the present disclosure may be rotatably provided to wash dishes stored in the vane non-movement section 12.

As shown in FIG. 4, when the vane 400 moves to the vane non-movement section 12 from the vane movement section 11 and rotates toward the vane non-movement section 12, washing water may be deflected toward dishes in the vane non-movement section 12. Hereinafter, main components of the dish washing machine 1 will be sequentially described with reference to the attached drawings.

First, operations, a flow channel structure, a lower nozzle structure, and a washing water distribution structure of the dish washing machine 1 will be described with reference to FIG. 5.

Figure 5:
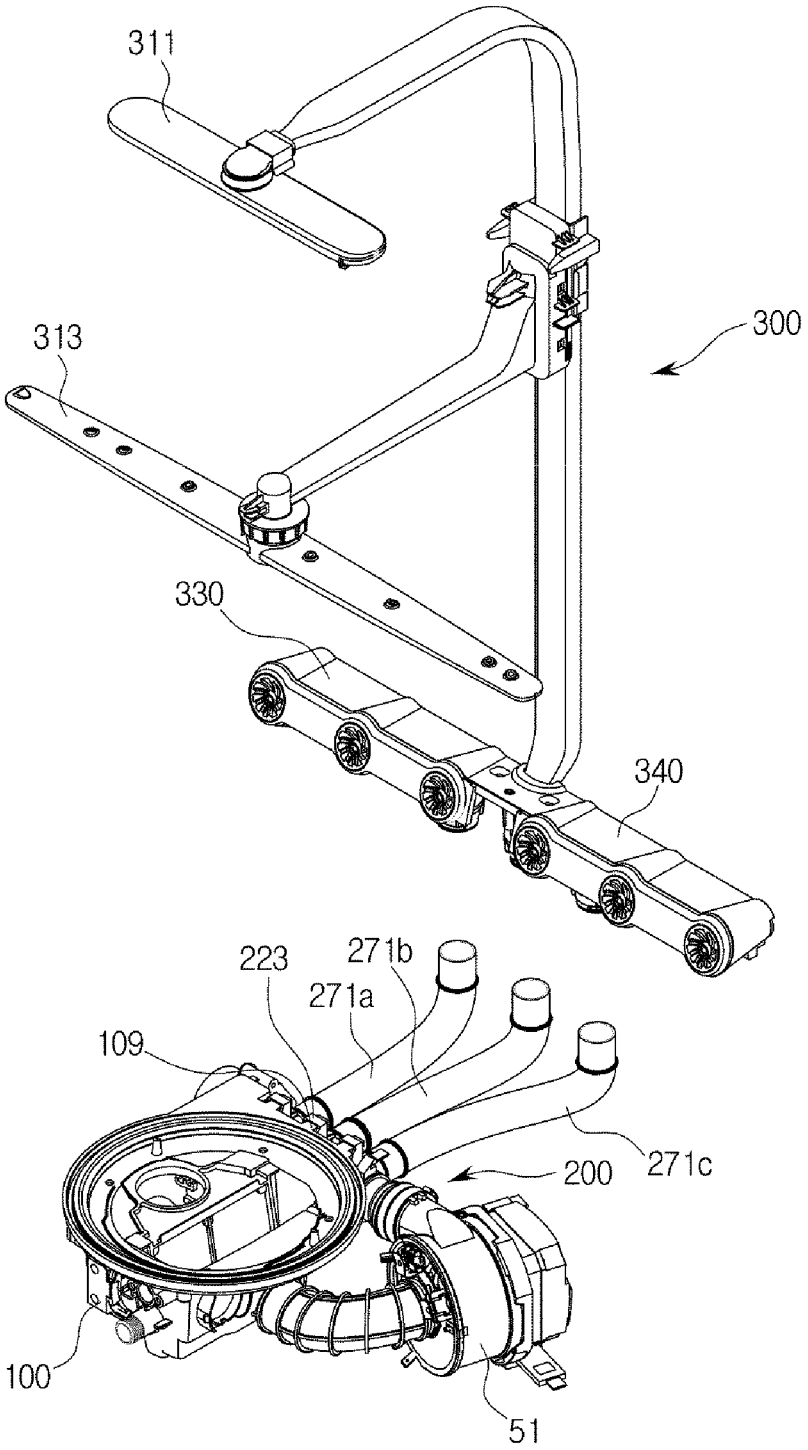
FIG. 5 is a view illustrating a flow channel structure of the dish washing machine in accordance with one embodiment of the present disclosure.

FIG. 5 is a view illustrating a flow channel structure of the dish washing machine in accordance with one embodiment of the present disclosure.

Operations of the dish washing machine 1 in accordance with one embodiment of the present disclosure may include a water supply operation, a washing operation, a draining operation, and a drying operation.

In the water supply operation, when washing water is supplied to the washing tub 30 through a water supply pipe (not shown), the washing water supplied to the washing tub 30 flows to the sump 100 provided at the bottom of the washing tub 30 due to a grade of the bottom plate 35 of the washing tub 30 and is stored at the sump 100.

In the washing operation, the circulation pump 51 operates to pump the washing water stored at the sump 100. The washing water pumped by the circulation pump 51 is distributed to the upper nozzle 311, the intermediate nozzle 313, the left lower nozzle 330, and the right lower nozzle 340 through a distribution device 200. The washing water may be jetted from a nozzle assembly 300 at a high pressure to wash dishes due to a pumping force of the circulation pump 51.

Here, the upper nozzle 311 and the intermediate nozzle 313 may receive washing water through a second hose 271*b* of the distribution device 200. The left lower nozzle 330 may receive washing water through a first hose 271*a* of the distribution device 200. The right lower nozzle 340 may receive washing water through a third hose 271*c* of the distribution device 200.

In the embodiment, the distribution device 200 is configured to have a total of four distribution modes.

In a first mode, the distribution device 200 supplies washing water to the upper nozzle 311 and the intermediate nozzle 313 through the second hose 271*b*.

In a second mode, the distribution device 200 supplies washing water to the right lower nozzle 340 through the third hose 271*c*.

In a third mode, the distribution device 200 supplies washing water to the left lower nozzle 330 and the right lower nozzle 340 through the first hose 271*a* and the third hose 271*c*.

In a fourth mode, the distribution device 200 supplies washing water to the left lower nozzle 330 through the first hose 271*a*.

Meanwhile, the distribution device 200 may be configured to have a larger variety of distribution modes unlike the example described above.

The washing water jetted from the nozzles 311, 313, 330, and 340 may hit dishes to remove foreign material on the dishes, may fall with the foreign material, and may be stored at the sump 100 again. The circulation pump 51 re-pumps and circulates the washing water stored at the sump 100. In the washing operation, the circulation pump 51 may repeatedly operate and stop several times. In this process, the foreign material falling into the sump 100 with the washing water is collected by a filter installed in the sump 100, does not circulate through the nozzles 311, 313, 330, and 340, and remains at the sump 100.

In the draining operation, the drain pump 52 may operate to discharge the foreign material which remains in the sump 100 with the washing water from the body 10 to the outside.

In the drying operation, a heater (not shown) mounted on the washing tub 30 may operate to dry dishes.

Figure 6:
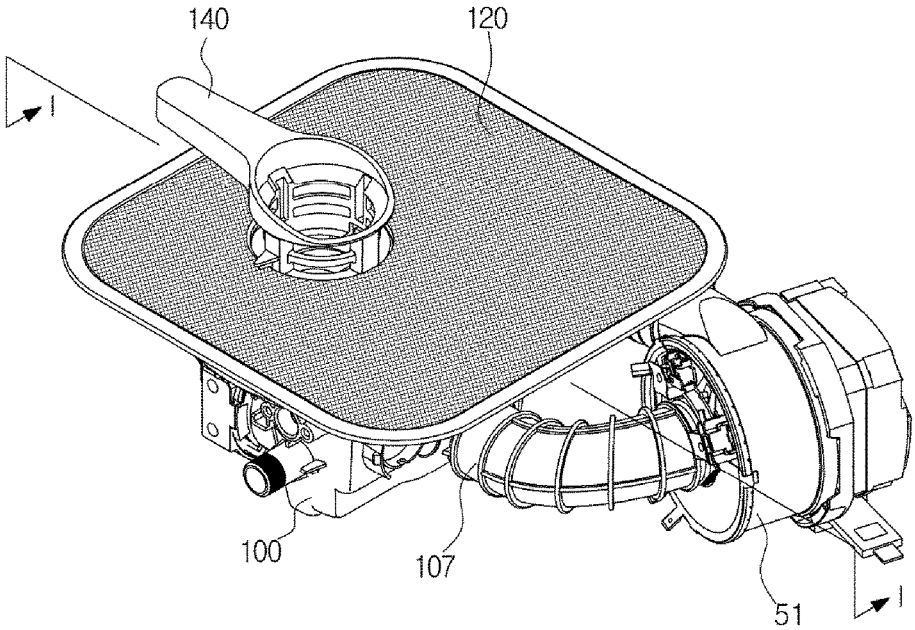
FIG. 6 is a view illustrating a sump, a coarse filter, and a fine filter of the dish washing machine in accordance with one embodiment of the present disclosure.
Figure 7:
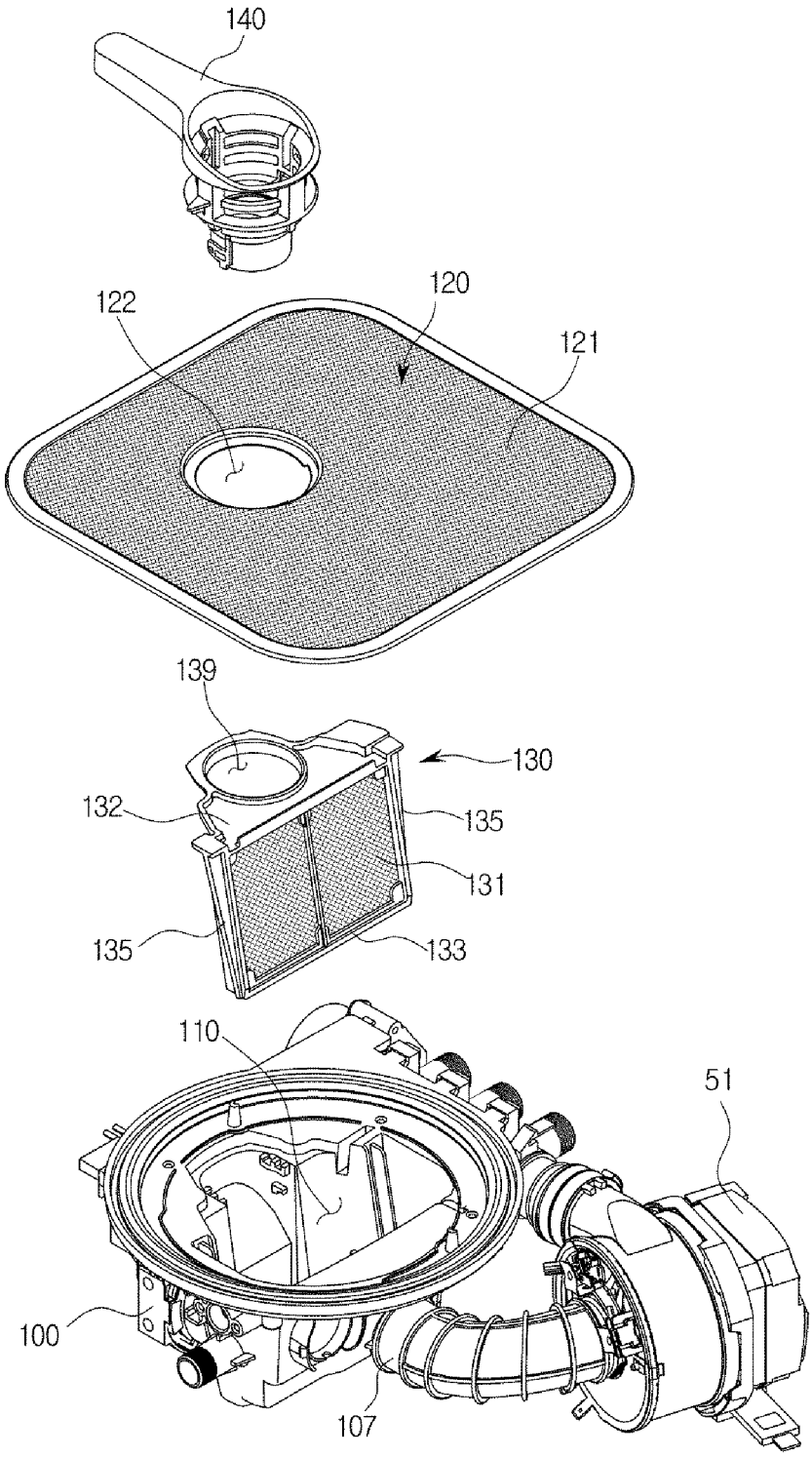
FIG. 7 is an exploded view illustrating the sump, the coarse filter, the fine filter, and a micro filter of the dish washing machine in accordance with one embodiment of the present disclosure.
Figure 8:
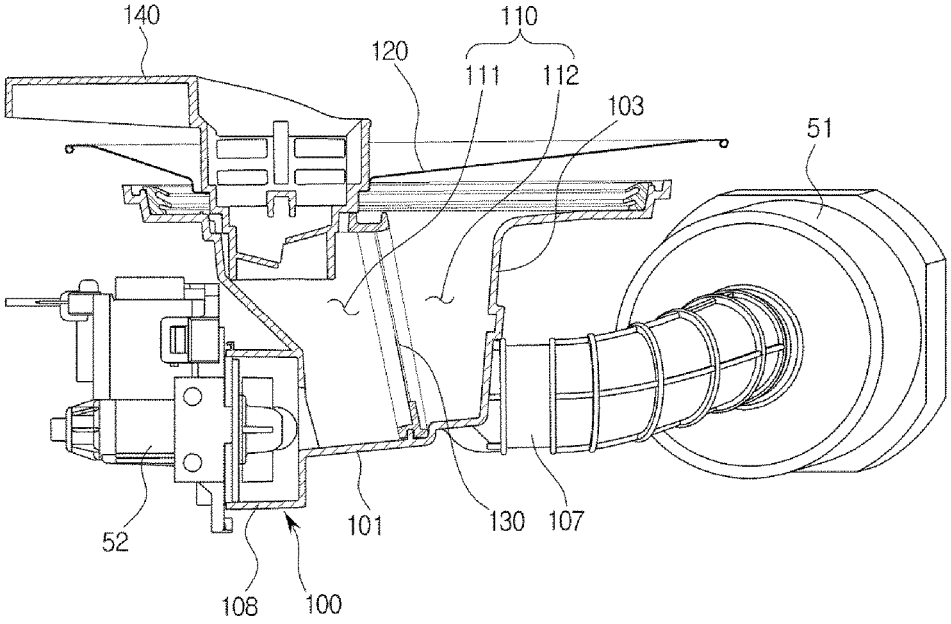
FIG. 8 is a cross-sectional view illustrating a portion taken along line I-I of FIG. 6.
Figure 9:
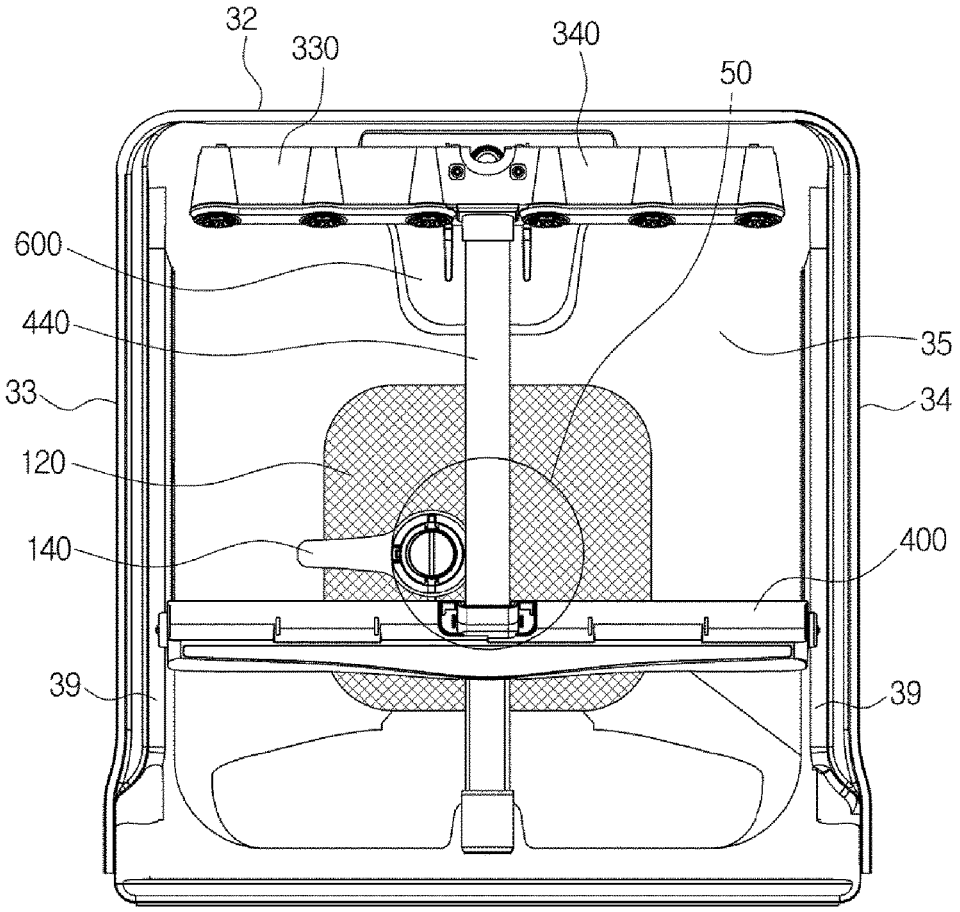
FIG. 9 is a plan view illustrating the bottom of the washing tub of the dish washing machine in accordance with one embodiment of the present disclosure.

FIG. 6 is a view illustrating a sump, a coarse filter, and a fine filter of the dish washing machine in accordance with one embodiment of the present disclosure. FIG. 7 is an exploded view illustrating the sump, the coarse filter, the fine filter, and a micro filter of the dish washing machine in accordance with one embodiment of the present disclosure. FIG. 8 is a cross-sectional view illustrating a portion taken along line I-I of FIG. 6. FIG. 9 is a plan view illustrating the bottom of the washing tub of the dish washing machine in accordance with one embodiment of the present disclosure.

Referring to FIGS. 6 to 9, the dish washing machine 1 includes filters 120, 130, and 140 for filtering foreign material from washing water.

A drainage hole 50 for draining washing water to the sump 100 may be formed at the bottom plate 35 of the washing tub 30, and the bottom plate 35 of the washing tub 30 may be inclined toward the drainage hole 50 to enable the washing water to be guided to the drainage hole 50 due to its weight.

The sump 100 may have an approximately hemispherical shape with an open top.

The sump 100 includes a bottom portion 101, a sidewall portion 103, a water storage chamber 110 formed by the sidewall portion 103 to store washing water, a circulation port 107 which is connected to the circulation pump 51, and a drain port 108 which is connected to the drain pump 52.

The filters 120, 130, and 140 may include a fine filter 120 mounted on the drainage hole 50 of the bottom plate 350, and a coarse filter 140 and a micro filter 130 mounted on the sump 100.

The coarse filter 140 may have an approximately cylindrical shape. Also, the coarse filter 140 may be mounted on an inner surface of the sidewall portion 103 of the sump 100 to filter out relatively large foreign material.

Also, the coarse filter 140 passes through a through hole 139 of the micro filter 130 and a through hole 122 of the fine filter 120, and is mounted on the sump 100. The top of the coarse filter 140 protrudes inside the washing tub 30, and a bottom thereof protrudes toward a foreign material collecting chamber 111 of the sump 100.

The fine filter 120 may include a filter portion 121 which filters foreign material of a relatively medium size or more and the through hole 122 through which the coarse filter 140 passes. The fine filter 120 may be mounted on the drainage hole 50 of the bottom plate 35 of the washing tub 30 to be approximately horizontal. The fine filter 120 may have an incline to enable washing water to be guided toward the through hole 122 due to its weight.

Washing water in the washing tub 30 may flow toward the coarse filter 140 along the incline of the fine filter 120. However, a portion of the washing and foreign material may pass through the filter portion 121 of the fine filter 120 and may directly flow to the water storage chamber 110 of the sump 100.

The micro filter 130 may include a filter portion 131 which filters foreign material of a relatively small size or more and has a flat shape, frames 132, 133, and 135 which support the filter portion 131, and the through hole 139 through which the coarse filter 140 passes.

The frames 132, 133, and 135 include an upper frame 132, a lower frame 133, and side frames 135. The micro filter 130 is mounted on the sump 100 to enable the lower frame 133 to be in close contact with the bottom portion 101 of the sump 100 and the side frames 135 to be in close contact with the sidewall portion 103 of the sump 100.

The micro filter 130 may partition the water storage chamber 110 of the sump 100 into the foreign material collecting chamber 111 and a circulation chamber 112. The drain pump 52 is connected to the foreign material collecting chamber 111, and the circulation pump 51 is connected to the circulation chamber 112.

As described above, since the coarse filter 140 is provided such that a bottom thereof protrudes into the foreign material collecting chamber 111, washing water which passes through the coarse filter 140 and foreign material included in the washing water flow into the foreign material collecting chamber 111.

The washing water which flows into the foreign material collecting chamber 111 may pass through the micro filter 130 and may flow into the circulation chamber 112. However, since the foreign material cannot pass through the micro filter 130, the foreign material included in the washing water which flows into the foreign material collecting chamber 111 cannot flow into the circulation chamber 112 and remains in the foreign material collecting chamber 111.

The foreign material collected at the foreign material collecting chamber 111 and the washing water may be discharged together outside the body 10 when the drain pump 52 is driven.

Meanwhile, it is necessary for the micro filter 130 to be in close contact with the bottom portion 101 and the sidewall portion 103 of the sump 100 to prevent the foreign material in the foreign material collecting chamber 111 from flowing into the circulation chamber 112 through a gap between the micro filter 130 and the sump 100.

For this, a lower sealing groove 134 may be formed at the lower frame 133 of the micro filter 130, and a side sealing protrusion 136 may be formed at the side frame 135. Correspondingly, a lower sealing protrusion 102 to be inserted into the lower sealing groove 134 may be formed at the bottom portion 101 of the sump 100, and a side sealing groove 104 into which the side sealing protrusion 136 is inserted may be formed at the sidewall portion 103 of the sump 100.

Due to a structure including the lower and side protrusions and grooves as described above, a seal of the micro filter 130 and the sump 100 may be strengthened.

Meanwhile, the coarse filter 140 may be vertically inserted downward into the sump 100 and then may be rotated from a releasing position to a fastening position to be mounted on the sump 100.

The coarse filter 140 may be disposed to tilt toward one of either of the sidewalls 33 and 34 of the washing tub 30. That is, the coarse filter 140 may be disposed more adjacent to the left wall 33 than the right wall 34. When the coarse filter 140 is separated through a disposition of the coarse filter 140, the coarse filter 140 may be easily separated without interfering with a rail 440.

Hereinafter, the operations of the dish washing machine 1 will be described in detail based on the structure of the dish washing machine 1 described above.

Figure 10:
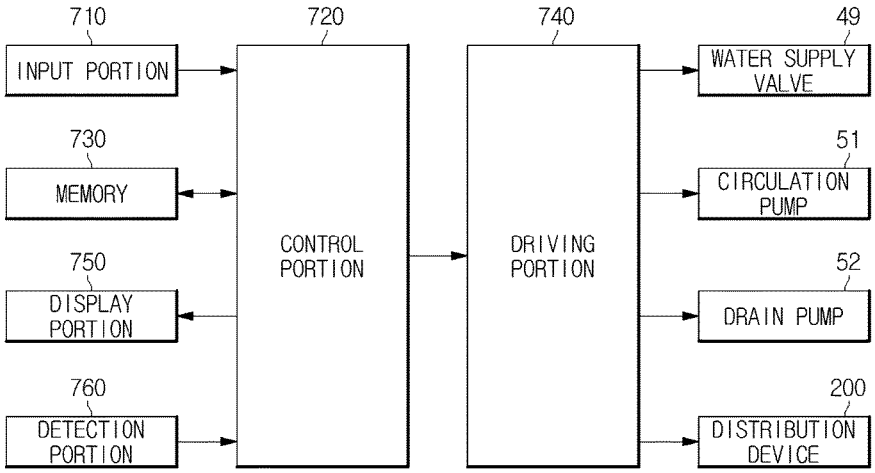
FIGS. 10 and 11 are control block diagrams of the dish washing machine in accordance with one embodiment of the present disclosure.
Figure 11:
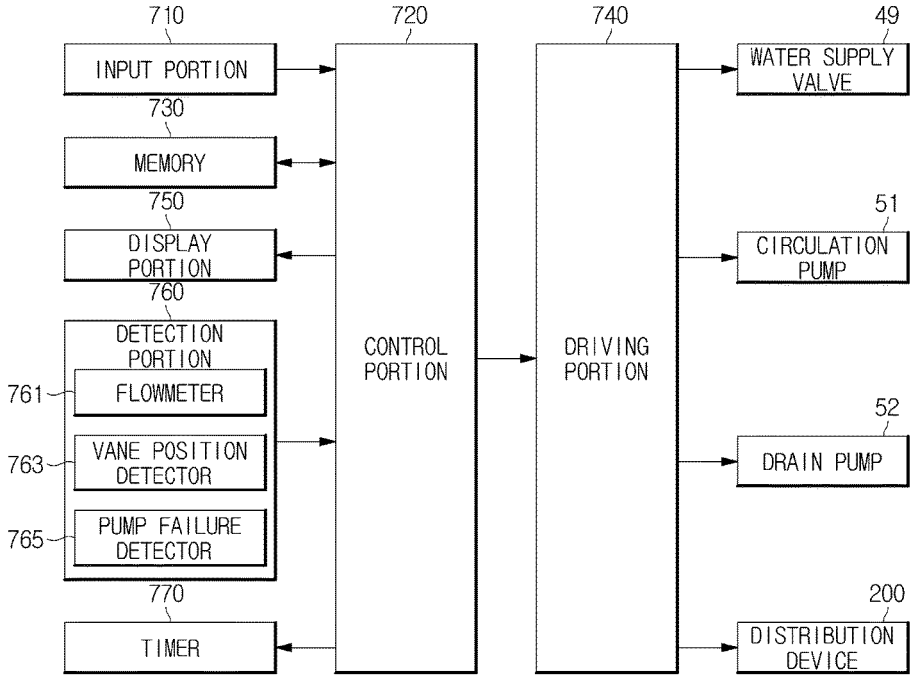

FIGS. 10 and 11 are control block diagrams of the dish washing machine in accordance with one embodiment of the present disclosure.

Referring to FIG. 10, the dish washing machine 1 may include an input device 710, a controller 720, a memory 730, a driver 740, a display 750, and a detector 760.

The input device 710 may receive a command for performing the water supply operation, the washing operation, the draining operation, the drying operation, or the like of the dish washing machine 1 according to an operation of a user.

Also, the input device 710 may receive a command with respect to operation information such as a washing course, a washing water temperature, additional rinsing, of the like from the user.

The washing course may include a standard course which sequentially operates processes of each of the operations including the water supply operation which supplies washing water, the washing operation which jets the washing water to wash dishes, a heating operation which heats the washing water to a temperature appropriate for washing and rinsing before jetting the washing water onto dishes, the draining operation which discharges the washing water outside after washing, the drying operation which completely dries washed dishes after washing, and a manual course in which the user arbitrarily selects and operates each operation corresponding to a situation.

The input device 710 may receive a command input through a pressure or touch applied by the user, and may include a jog shuttle used by being pushed or turned upward, downward, leftward, or rightward.

The display 750 may display a screen for showing an operational state of the dish washing machine 1 or a screen for guiding an input of the user.

The display 750 may include a display panel such as a light emitting diode (LED) panel, a liquid crystal display (LCD) panel, an organic light emitting diode (OLED) panel, etc.

The controller 720 may control overall operations of the dish washing machine 1 such as the water supply operation, the washing operation, the draining operation, the drying operation, and the like according to a command input through the input device 710. That is, the controller 720 may generate control signals for controlling a water supply valve 49, the circulation pump 51, the drain pump 52, the distribution device 200, or the like to perform each operation.

The controller 720 may include a processor which executes a program for performing the operations of the dish washing machine 1. A single processor may be included, or a plurality of processors according to the operations of the dish washing machine 1 may be included.

The memory 730 may store setting information such as the program for performing the operations of the dish washing machine 1, control data for controlling the operations of the dish washing machine 1, reference data used during the control of the operations of the dish washing machine 1, operational data which occurs while the dish washing machine 1 performs a certain operation, setting data input by the input device 710 to enable the dish washing machine 1 to perform a certain operation, usage information including the number of times a certain operation is to be performed by the dish washing machine 1 and model information of the dish washing machine 1, and failure information including a cause of malfunction or a malfunction position when the dish washing machine 1 malfunctions.

The memory 730 described above may include not only a nonvolatile memory (not shown) which permanently stores data such as a magnetic disc, a solid-state disc, or the like but also a volatile memory (not shown) which temporarily stores data generated during a process of controlling the operations of the dish washing machine 1 such as a dynamic random access memory (D-RAM), a static random access memory (S-RAM), or the like.

The water supply valve 49 controls supplying of water (washing water) to be supplied into the washing tub 30 through the water supply pipe during the water supply operation. For example, washing water is supplied to the washing tub 30 through the water supply pipe when the water supply valve 49 is opened and the supply of the washing water is stopped when the water supply valve 49 is closed.

The circulation pump 51, the drain pump 52, the distribution device 200, and the vane 400 have been described above.

The driver 740 drives the water supply valve 49, the circulation pump 51, the drain pump 52, the distribution device 200, the vane 400, and the like related to the operations of the dish washing machine 1 according to control signals of the controller 720. For this, the driver 740 may include at least one motor which generates power to be provided to the water supply valve 49, the circulation pump 51, the drain pump 52, the distribution device 200, and the vane 400 and may further include a component for transferring the generated power such as a gear or the like as necessary.

Also, a plurality of motors respectively corresponding to the water supply valve 49, the circulation pump 51, the drain pump 52, the distribution device 200, and the vane 400 may be provided and may be arranged at positions for providing power to the water supply valve 49, the circulation pump 51, the drain pump 52, the distribution device 200, and the vane 400.

For example, a motor providing power to the vane 400 may be disposed below a bottom plate cover 600, and the driving device 420 for the vane 400 described above may be included in the driver 740.

The detector 760 may detect and transfer information related to a state of the dish washing machine 1 to the controller 720. The controller 720 may perform an operation corresponding to the information transferred from the detector 760.

According to an example of FIG. 11, the detector 760 may include a flowmeter 761 which detects a flow rate of washing water supplied to the washing tub 30, a vane position detector 763, and a pump failure detector 765 which detects a failure of the circulation pump 51.

Also, since the dish washing machine 1 may further include a timer 770, the controller 720 may check a water supply amount, a water drain amount, a washing water jetting amount, and the like by counting times during which the water supply valve 49, the circulation pump 51, and the drain pump 52 are controlled, that is, times during which the water supply valve 49, the circulation pump 51, and the drain pump 52 are driven using the driver 740.

The vane position detector 763 may include a permanent magnet installed at a bottom surface of the vane 400 and a magnetic sensor which is installed at a position corresponding to the permanent magnet and senses a magnetic field of the permanent magnet.

The permanent magnet may be a position identifying member which moves with the vane 400 and generates a magnetic field, and the magnetic sensor may be installed at the bottom plate cover 600 and may sense the magnetic field generated by the permanent magnet.

On a movement path of the vane 400, a position at which the magnetic sensor detects the magnetic field of the permanent magnet may be determined as a reference position. The reference position may be the above-described second position.

The vane position detector 763 may not include the permanent magnet and the magnetic sensor, and may include a protrusion, a micro switch, a permanent magnet, a reed switch, an infrared sensor module, a capacitive proximity sensor, an ultrasonic sensor module, or the like.

The reference position may be a reference point of movement of the vane 400. In detail, the dish washing machine 1 may calculate a position of the vane 400 by moving the vane 400 based on the reference position. For example, when the vane 400 is disposed at a particular position, the dish washing machine 1 may move the vane 400 to a desired position by moving the vane 400 based on the reference position.

When the washing operation or the draining operation of the dish washing machine 1 is started or finished, the dish washing machine 1 disposes the vane 400 at the reference position. That is, the reference position may include a position at which the vane 400 starts moving and a position at which the vane 400 finishes moving.

For example, the controller 720 may move the vane 400 to an initial position before the draining operation. That is, a control signal for moving the vane 400 to the initial position may be transmitted to the driver 740.

Also, in a state in which the vane 400 is moved to the initial position before the draining operation, the controller 720 may control RPM of the circulation pump 51 to remove foreign material which remains at the bottom of the washing tub 30, particularly at the fine filter 120, by strongly jetting washing water. That is, a control signal for controlling the RPM of the circulation pump 51 may be transmitted to the driver 740.

Also, the controller 720 may control the circulation pump 51 to operate for a reference time (a time for jetting the washing water to remove the foreign material which remains at the bottom of the washing tub 30: about 3 seconds or less) by counting a driving time of the circulation pump 51 to remove the foreign material which remains at the fine filter 120.

For this, when the vane 400 moves to approach the bottom plate cover 600 and arrives at a position which minimizes the gap between the vane 400 and the nozzle assembly 300, that is, the reference position, the controller 720 stops a motor which drives the vane 400, and drives the circulation pump 51 for a reference time (about 3 seconds or less) at a certain speed (about 2600 RPM) (refer to FIG. 4) such that washing water deflected by the vane 400 may hit the rear wall 32 of the washing tub 30.

Washing water which hits the rear wall 32 of the washing tub 30 forms a quick and strong water current along the bottom plate 35 of the washing tub 30 such that the quick and strong water current flows toward the fine filter 120 mounted on the bottom of the washing tub 30 and removes the foreign material which remains at the fine filter 120.

Meanwhile, when a separate vane position detector 763 for detecting the reference position of the vane 400 is not installed, a motor 530 is driven and the vane 400 is moved to the rearmost of a rail assembly 430, a driving current supplied to the driving motor 530 is detected while the motor 530 is driven, and a level of the detected driving current is a predetermined reference current or more, it is possible to determine that the vane 400 is positioned at the rearmost of the rail assembly 430 (the reference position).

As described above, it is necessary for washing water stored in the sump 100 to normally flow into the circulation pump 51 so that the washing operation, the rinsing operation, and the like may be smoothly performed. Accordingly, when washing water does not normally flow into the circulation pump 51, that is, when a pump failure is detected, the controller 720 may perform an appropriate operation for fixing the failure.

For this, the pump failure detector 765 detects whether washing water normally flows into the circulation pump 51, and various methods for detection may be employed.

When a circulation amount of washing water to be circulated by the circulation pump 51 is reduced, power consumption of the circulation pump 51 decreases. Accordingly, the pump failure detector 765 may monitor the power consumption of the circulation pump 51 and may detect and transfer a change in power consumption, and particularly a decrease of the power consumption, to the controller 720.

In detail, as an example, the pump failure detector 765 may monitor current applied to the circulation pump 51 and may transfer a pump failure detection signal to the controller 720 when a change in current increases to a preset reference value or more.

Since a jet pressure may be reduced when a circulation amount of washing water circulated by the circulation pump 51 decreases, washing performance may be deteriorated and abnormal noise may occur due to cavitation.

Accordingly, when the dish washing machine 1 in accordance with one embodiment of the present disclosure detects a pump failure, the controller 720 performs an operation for fixing the pump failure. It is necessary to perform operations for checking for a cause of the pump failure and removing the cause to fix the pump failure.

During the washing operation, bubbles may occur due to external causes such as foreign material, a detergent, washing water, or the like while washing water is jetted. Particularly, a large amount of bubbles occur when eggshells or the like are present. When bubbles occur during the washing operation, a problem occurs in a process in which washing water flows into the circulation pump 51 such that a circulation amount of the washing water notably decreases and the power consumption of the circulation pump 51 decreases. Accordingly, bubbles occurring in the washing tub 30 may be a cause of interference in circulation of the washing water in the sump 100, that is, a cause of generation of a failure of the circulation pump 51.

Also, even when the filters 120, 130, and 140 are blocked by foreign material, washing water does not smoothly flow into the circulation pump 51 and the circulation of the washing water is interfered with.

In addition, washing water is not normally circulated when there is an insufficient supply of water.

Accordingly, when a failure of the circulation pump 51 is detected, the controller 720 may sequentially or selectively perform a bubble removal operation, a filter blockage removal operation, and a water supply operation to smoothly circulate washing water.

In detail, when a failure of the circulation pump 51 is detected, one of the bubble removal operation, the filter blockage removal operation, and the water supply operation is performed as a first operation. When a failure of the circulation pump 51 is detected after the first operation is completed, one of the two remaining operations may be performed as a second operation. Also, when a failure of the circulation pump 51 is detected after the second operation is completed, the one remaining operation may be performed as a third operation.

When two or more operations among the three operations are performed, there is no limit in performing order. That is, although there is no limitation which of the operations among the bubble removal operation, the filter blockage removal operation, and the water supply operation is performed as the first operation, the second operation, and the third operation, an example in which the bubble removal operation, the filter blockage removal operation, and the water supply operation are sequentially performed will be described in the following embodiment.

Figure 12:
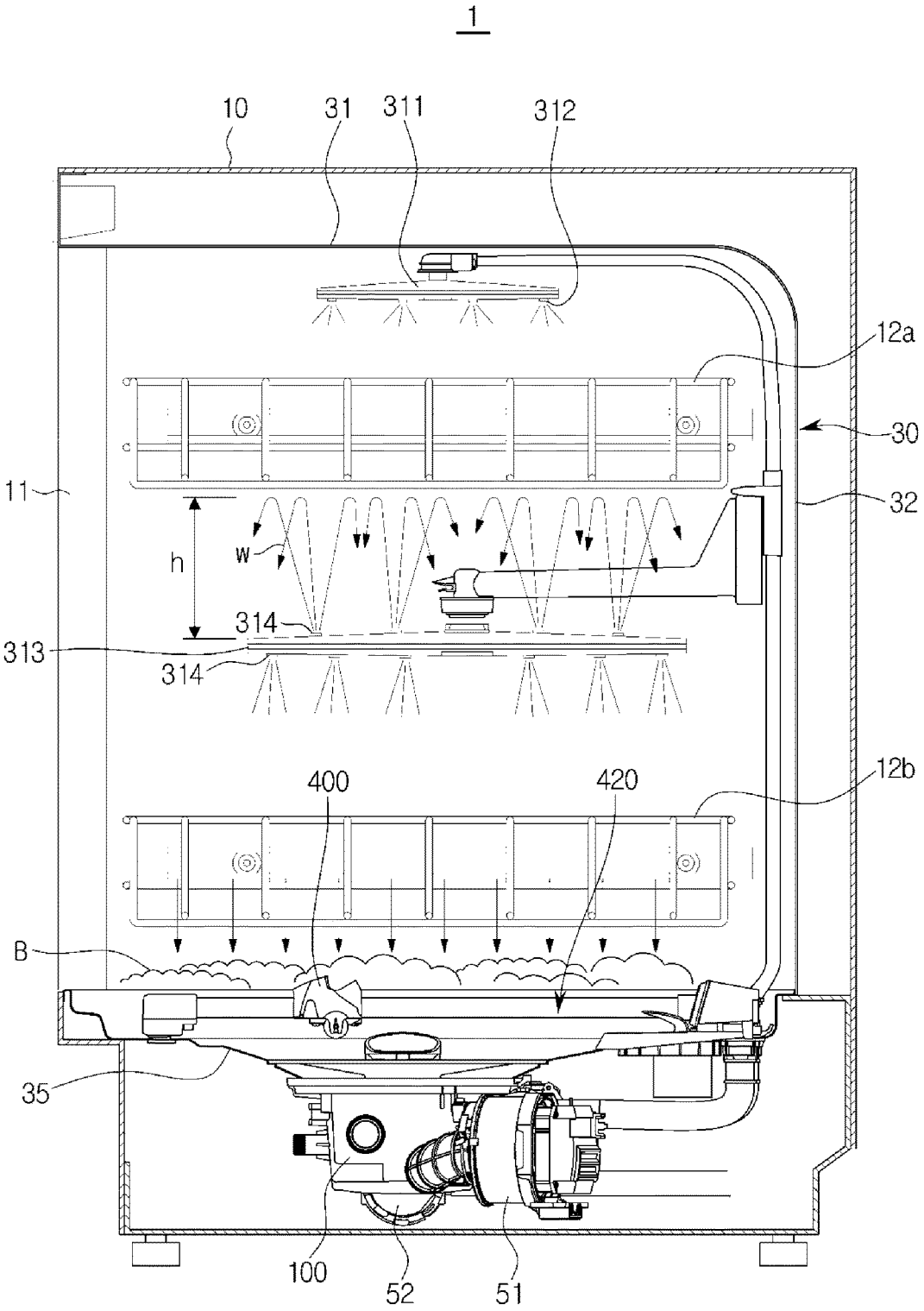
FIG. 12 is a view illustrating an example of a bubble removal operation performed by the dish washing machine in accordance with one embodiment of the present disclosure.

FIG. 12 is a view illustrating an example of a bubble removal operation performed by the dish washing machine in accordance with one embodiment of the present disclosure.

When a decrease in the power consumption of the circulation pump 51 is detected, the controller 720 stops an operation which is being performed at a time at which the decrease in power consumption is detected. The stopped operation may correspond to an operation which requires washing water to be circulated, that is, the washing operation or the rinsing operation.

After the operation which is being performed is stopped, the controller 720 may remove bubbles B which occur by directly jetting washing water onto the bubbles B as shown in FIG. 12.

Here, the controller 720 may control the distribution device 200 to jet the washing water through at least one of the upper nozzle 311, the intermediate nozzle 313 and the lower nozzles 330 and 340. As an example, as shown in FIG. 12, when the washing water is jetted through the intermediate nozzle 313, the jetted washing water may fall toward the bottom plate 35 and may directly hit the bubbles B, and the bubbles B may be removed by being hit by the washing water.

Also, the controller 720 may control a flow rate of washing water to be supplied to the nozzle by controlling the RPM of the circulation pump 51. As an example, the RPM of the circulation pump 51 may be controlled to a level lower than a speed (for example, 3,000 to 3,400 RPM) applied to the washing operation or the rinsing operation to enable washing water W jetted from the intermediate nozzle 313 toward the top of the washing tub 30 to fall after moving upward to a reference height h as shown in FIG. 12.

Here, the reference height h refers to an uppermost height of the washing water W jetted from the intermediate nozzle 313, and may be a height which does not collide with the bottom of the upper basket 12*a*. The washing water W jetted from the intermediate nozzle 313 may fall before arriving at the bottom of the upper basket 12*a*, thereby preventing a phenomenon in which bubbles are increased while the jetted washing water collides with the bottom of the upper basket 12*a* or dishes.

Meanwhile, since the RPM of the circulation pump 51 may be controlled at a first speed, the first speed may be set to be less than a speed at which the washing water jetted from the intermediate nozzle 313 arrives at the upper basket 12*a*, and may be set to a lowest speed necessary for rotating the intermediate nozzle 313 or more. When the intermediate nozzle 313 rotates due to water pressure of the jetted washing water, an area of bubbles removed by the washing water may increase in comparison to a case in which the intermediate nozzle 313 does not rotate.

The first speed may be predetermined through experiments, simulations, or the like, a value set according design options of the dish washing machine 1 may change. As one experimental example, when the circulation pump 51 was operated at a speed of 1200 RPM to supply washing water to the intermediate nozzle 313, the intermediate nozzle 313 did not rotate and jetted washing water did not arrive at the bottom of the upper basket 12*a*. In this case, a time of 27 seconds was necessary to remove bubbles, and the time necessary was reduced by 46% when compared to a case of stopping the circulation pump 51.

Also, when the circulation pump 51 was operated at a speed of 1400 RPM to supply washing water to the intermediate nozzle 313, the intermediate nozzle 313 rotated and jetted washing water did not arrive at the bottom of the upper basket 12*a*. In this case, a time of 18 seconds was necessary to remove bubbles, and the time necessary was reduced by 64% when compared to the case of stopping the circulation pump 51.

Also, when the circulation pump 51 was operated at a speed of 1600 RPM to supply washing water to the intermediate nozzle 313, the intermediate nozzle 313 rotated and jetted washing water did not arrive at the bottom of the upper basket 12*a*. In this case, a time of 15 seconds was necessary to remove bubbles, and the time necessary was reduced by 70% when compared to the case of stopping the circulation pump 51.

Meanwhile, the controller 720 may perform the bubble removal operation for a first time. That is, the RPM of the circulation pump 51 may be controlled at the first speed for the first time. Like the experimental example described above, since the time used for removing bubbles varies according to the RPM of the circulation pump 51, the first time may be appropriately set according to the first speed.

When the first time passes after the circulation pump 51 is operated at the first speed, the controller 720 may slow start the circulation pump 51 at a second speed. As an example, when the circulation pump 51 is slowly operated at a speed from about 1600 RPM to 3000 RPM, bubbles which are not removed by being hit by washing water and remain at the bottom may be prevented from rapidly moving upward.

The slow start of the circulation pump 51 may be performed for the second time, and the second time may be set to about 1 minute.

When the second time passes after performing the slow start of the circulation pump 51, the controller 720 may jet washing water through the upper nozzle 311 and the intermediate nozzle 313 by driving the circulation pump 51 at a third speed for a third time. Here, the third speed may be set considering a water pressure necessary for washing the bubbles which remain at the bottom of the washing tub 30, and the third time may be set as an appropriate time necessary for washing the bubbles at the bottom of the washing tub 30. As an example, the third speed may be set within a range of about 3000 RPM to 3400 RPM and the third time may be set to about 1 minute.

Also, after the washing water is jetted through the upper nozzle 311 and the intermediate nozzle 313, the controller 720 may control the distribution device 200 to jet washing water through the lower nozzles 330 and 340. Here, since the RPM of the circulation pump 51 may be controlled at a fourth speed and a jetting time may be controlled to a fourth time, the fourth speed and the fourth time may be set identically to or differently from the third speed and the third time.

Meanwhile, in the above description, washing bubbles in the washing tub 30 by sequentially performing an operation of jetting washing water through the upper nozzle 311 and the intermediate nozzle 313 and then through the lower nozzles 330 and 340 has been described as an example. However, embodiments of the dish washing machine 1 are not limited thereto and the dish washing machine 1 may be configured to wash bubbles in the washing tub 30 by driving the circulation pump 51 again after the third time passes and jetting washing water through the upper nozzle 311 and the intermediate nozzle 313.

In addition, the dish washing machine 1 may be configured to wash bubbles in the washing tub 30 by driving the circulation pump 51 again and jetting washing water through the lower nozzles 330 and 340.

Also, the dish washing machine 1 may be configured to sequentially perform a washing water jetting operation through the upper nozzle 311 and the intermediate nozzle 313 and a washing water jetting operation through the lower nozzles 330 and 340, or may be configured to separately perform each of the operations or to perform the operations to be interconnected in parallel.

Also, as another example, when the bubble removal operation starts, the circulation pump 51 may not be driven and may stand by until bubbles subside to the bottom of the washing tub 30. In this case, an operation of driving the circulation pump 51 at the second speed for the second time to be slow started is identical to the example described above.

Also, it is possible to directly complete the bubble removal operation without performing the slow start after driving the circulation pump 51 at the first speed for the first time.

When a change in the power consumption of the circulation pump 51 falls below the reference value after the bubble removal operation is completed, the controller 720 may determine that circulation of washing water is normally performed by removing bubbles and may re-perform a previous operation which was performed before starting the bubble removal operation.

During the washing operation of the dish washing machine 1, such as during preliminary washing, main washing, or the like, a process in which foreign material which remains at dishes are separated from the dishes by jetted washing water and is collected at the filters 120, 130, and 140 at the bottom of the dish washing machine 1 is repeated to perform the washing operation.

Here, when an amount of foreign material is larger than an amount thereof that may be washed and filtered by the filters 120, 130, and 140, the filters 120, 130, and 140 may be temporarily blocked.

Accordingly, since washing water does not smoothly pass through the filters 120, 130, and 140, an amount of water stored in the sump 100 is reduced, and a circulation amount of washing water circulated to wash dishes is reduced such that washing is not normally performed.

Accordingly, when the change in power consumption is maintained as the reference value or more after the bubble removal is completed, the controller 720 determines that a filter blockage is included as a cause of the change in power consumption and starts the filter blockage removal operation.

A filter blockage removal algorithm removes foreign material which block the filters 120, 130, and 140 using a small amount of water (about 700 to 900 cc) when blockages of the filters 120, 130, and 140 are detected regardless of the washing operation such as the preliminary washing, the main washing, or the like.

The blockages of the filters 120, 130, and 140 may be removed by strongly flowing washing water along the bottom plate 35 of the washing tub 30 by driving the circulation pump 51 at a fifth speed (about 1200 to 1400 RPM) after supplying the small amount of water (about 700 to 900 cc).

Since a small amount of washing water capable filling an inside of the sump 100 is 700 to 900 cc, ¼ or less of an amount of water supplied during a general washing or rinsing operation is supplied during the filter blockage removal operation. For example, a washing water supply amount necessary for the washing operation may be a first water supply amount, and the first water supply amount may be 3400 to 4000 cc.

When an amount of washing water that exceeds a capacity of the sump 100 is supplied while the filters 120, 130, and 140 are blocked, it is difficult to remove the foreign material which block the filters 120, 130, and 140 because washing water jetted from the lower nozzles 330 and 340 does not directly hit the filters 120, 130, and 140, and so an amount of water supplied to remove the blockages of the filters 120, 130, and 140 is adjusted to be an amount which fills the sump 100.

Also, the fifth speed (about 1200 to 1400 RPM) is a speed at which washing water jetted from the lower nozzles 330 and 340 moves toward the filters 120, 130, and 140 positioned at the center of a bottom surface of the washing tub 30 and is a speed that is half or less the RPM (about 2600 RPM or more) at which washing water jetted from the lower nozzles 330 and 340 moves to an end of the door 11 during a normal operation. When the circulation pump 51 is driven at the RPM (about 2600 RPM) at which washing water moves to the end of the door 11 while the filters 120, 130, and 140 are blocked, it is difficult to remove the foreign material which block the filters 120, 130, and 140 because washing water jetted from the lower nozzles 330 and 340 does not directly hit the filters 120, 130, and 140 but hits the door 11.

FIGS. 13A to 13K are views illustrating an example of a filter blockage removal operation performed by the dish washing machine in accordance with one embodiment of the present disclosure.

The controller 720 may perform a first draining operation which completely drains foreign material which remains at the sump 100 and washing water by driving the drain pump 52 using the driver 740 to perform the filter blockage removal operation.

Figure 13A:
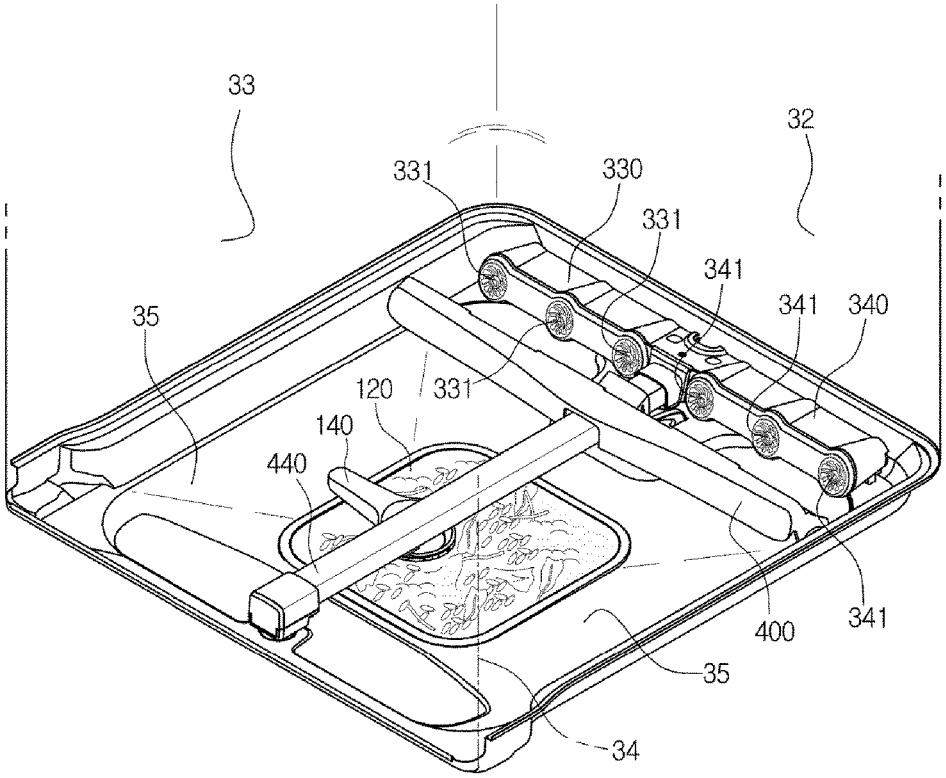
FIGS. 13A to 13K are views illustrating an example of a filter blockage removal operation performed by the dish washing machine in accordance with one embodiment of the present disclosure.
Figure 13B:
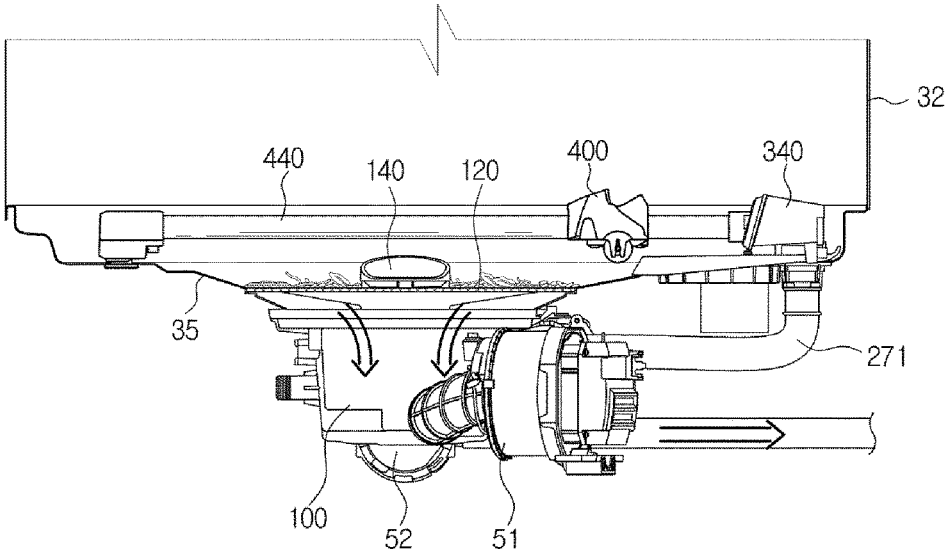

As shown in FIGS. 13A and 13B, the first draining operation may provide an effect of preliminarily removing a blockage of the micro filter 130 through a draining operation of discharging foreign material collected at the sump 100 and washing water together outside the body 10.

Figure 13C:
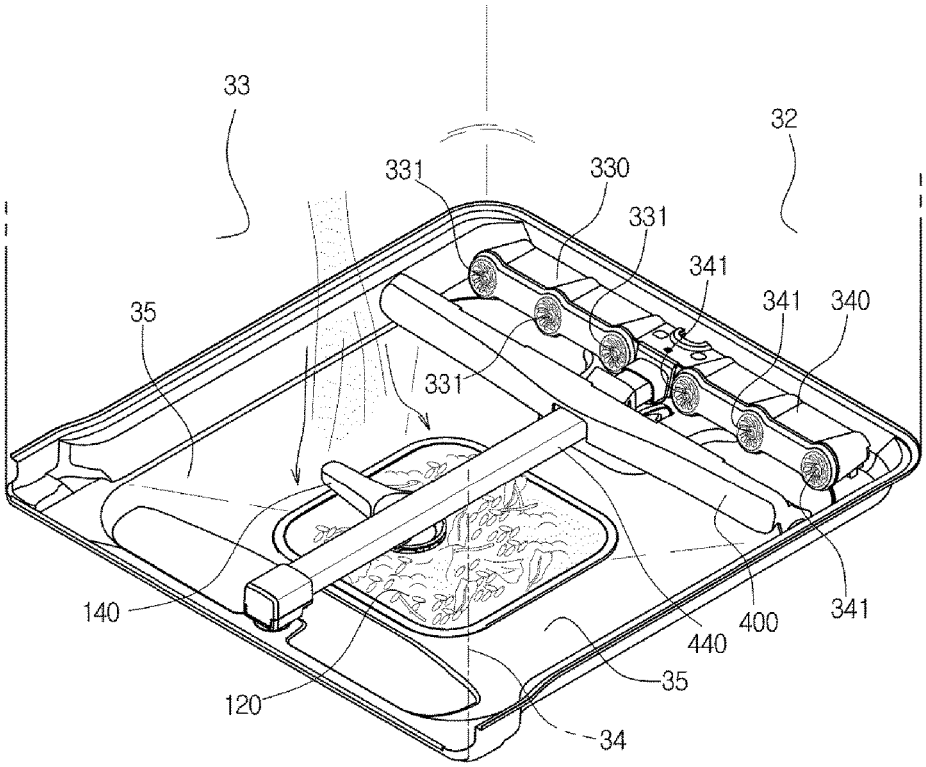

Referring to FIG. 13C, after the first draining operation, the controller 720 may stop driving the drain pump 52 using the driver 740 and may supply washing water for removing blockages of the filters 120, 130, and 140 to the washing tub 30 by driving the water supply valve 49.

When the washing water for removing the blockages of the filters 120, 130, and 140 is supplied, a flow amount of washing water to be supplied into the washing tub 30 may be adjusted to be a second water supply amount (a small amount of washing water capable of filling the inside of the sump, about 700 to 900 cc).

Figure 13D:
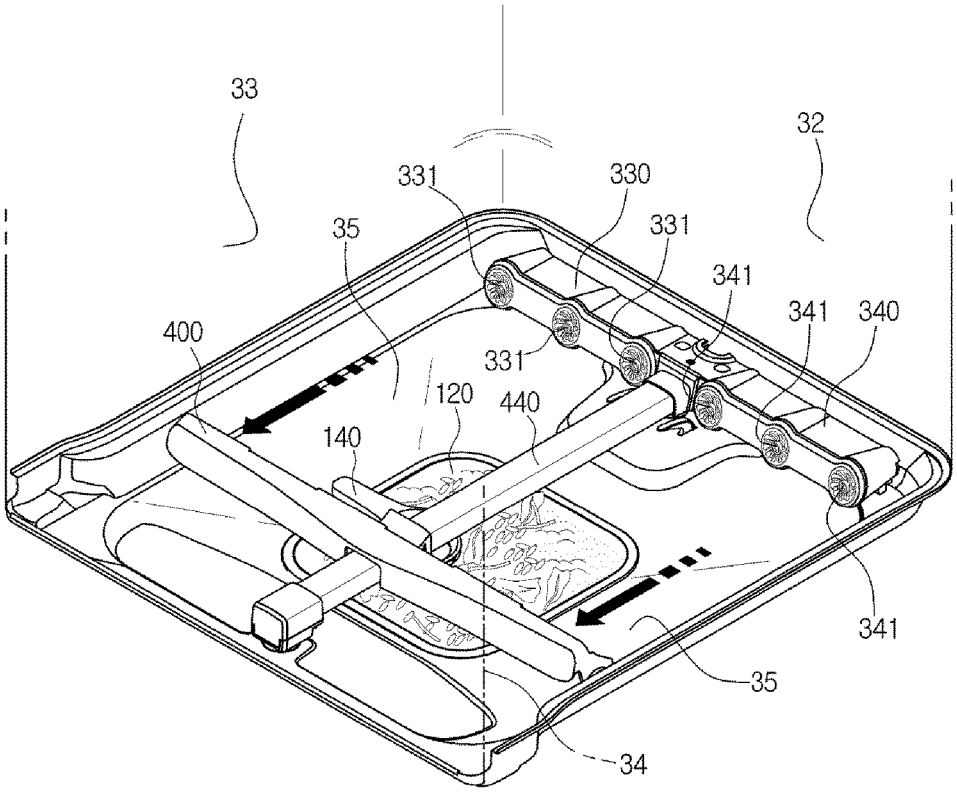

As shown in FIG. 13D, when the supply of the second water supply amount of washing water is complete, the controller 720 moves the vane 400 forward from the reference position for a certain time (about 7 seconds) using the driver 740 and then stops.

Figure 13E:
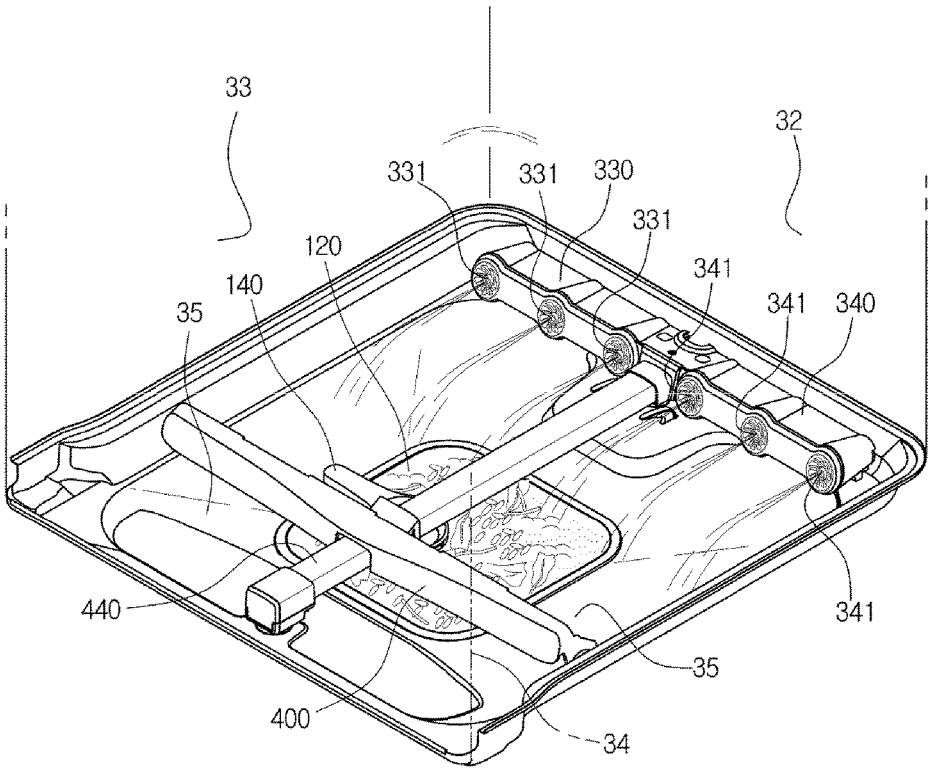
Figure 13F:
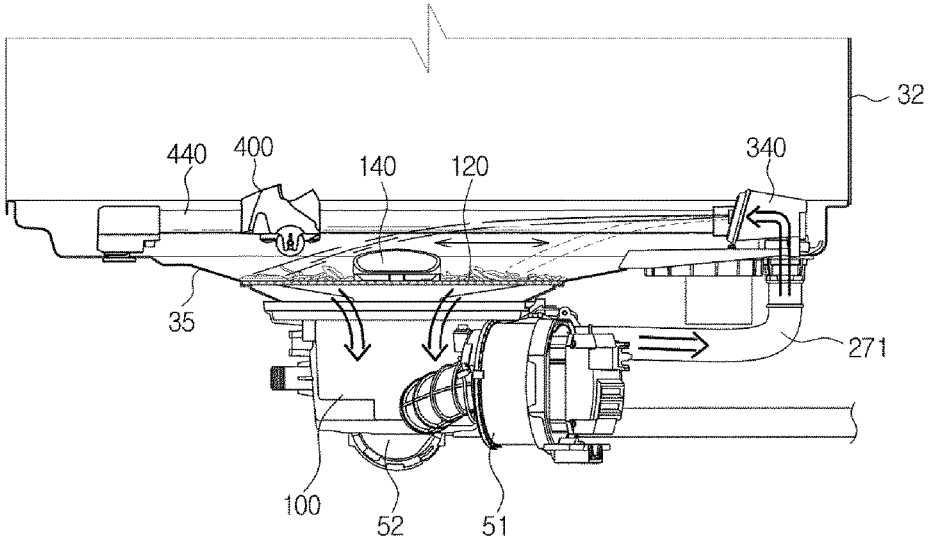

Referring to FIGS. 13E and 13F, after the vane 400 is moved forward, the controller 720 may drive the circulation pump 51 at a fifth RPM (about 1200 to 1400 RPM) for a fifth time such that washing water jetted from the lower nozzles 330 and 340 is jetted toward the filters 120, 130, and 140 on top of the sump 100.

The fifth time may be set in consideration of a time necessary for moving foreign material accumulated on top of the filters to the foreign material collecting chamber by jetting washing water and may be set, for example, to about 30 seconds.

After the fifth time passes, the controller 720 stops jetting the washing water by stopping the driving of the circulation pump 51 using the driver 740. Through the operation of jetting washing water, a first filter washing operation in which some of the foreign material accumulated on top of the filters 120, 130, and 140 is moved to the foreign material collecting chamber 111 to remove the blockages of the filters 120, 130, and 140 to some degree is performed.

Then, the controller 720 performs a second draining operation of draining foreign material which remains at the sump 100 and washing water for a certain time (about 30 seconds) by driving the drain pump 52 using the driver 740.

Figure 13G:
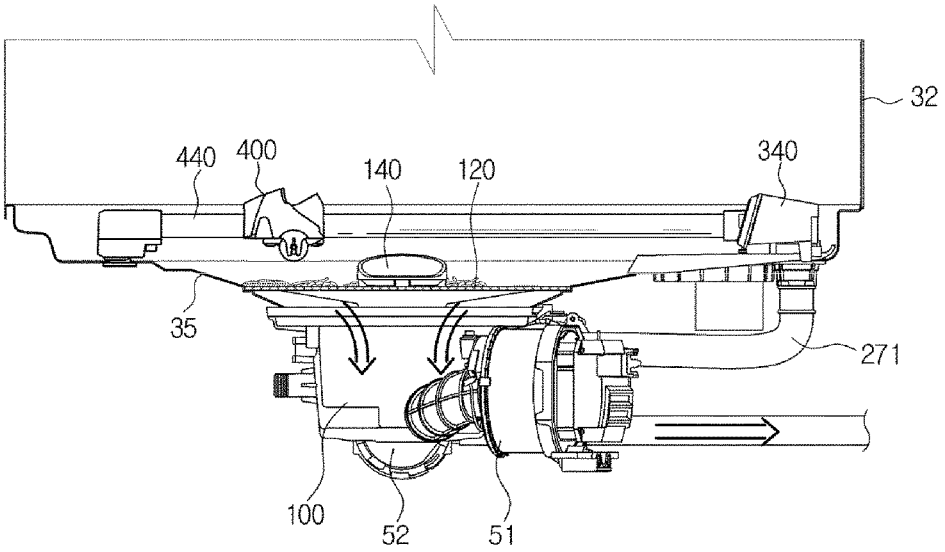

Referring to FIG. 13G, the second draining operation may provide an effect of secondarily removing the blockage of the micro filter 130 through a draining operation of discharging the foreign material collected at the foreign material collecting chamber 111 and washing water from the body 10 to the outside.

Figure 13H:
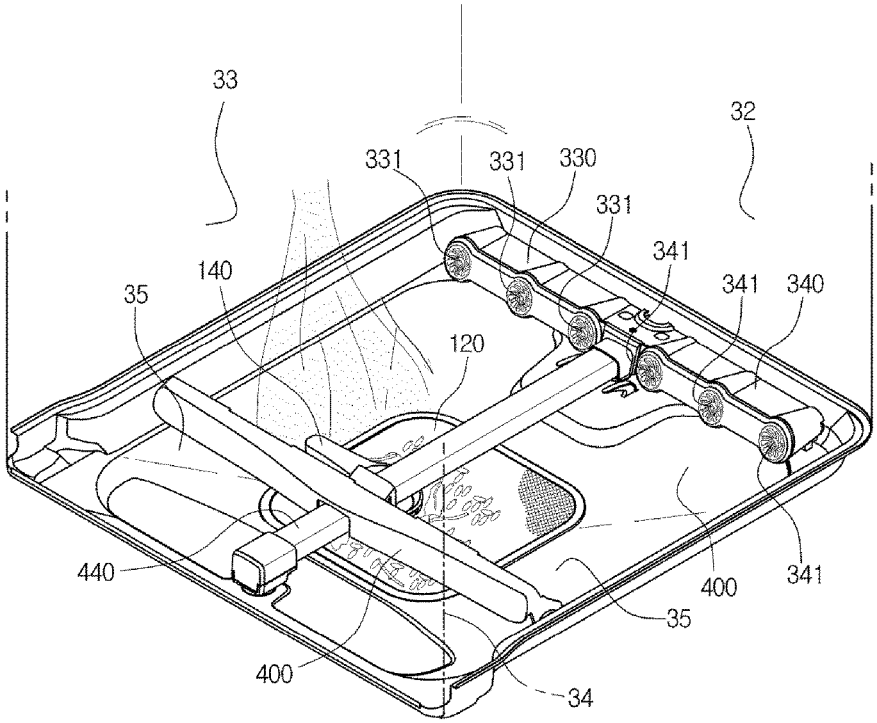

Referring to FIG. 13H, after the second draining operation, the controller 720 stops driving the drain pump 52 using the driver 740 and supplies washing water for removing the blockages of the filters 120, 130, and 140 to the washing tub 30 by driving the water supply valve 49.

When the washing water for removing the blockages of the filters 120, 130, and 140 is supplied, a flow amount of washing water to be supplied into the washing tub 30 is detected by a flowmeter 705, and the supply of the washing water continues until a third water supply amount (a small amount of washing water capable of filling the inside of the sump, about 700 cc) is reached. The third water supply amount may be smaller than the second water supply amount.

Figure 13I:
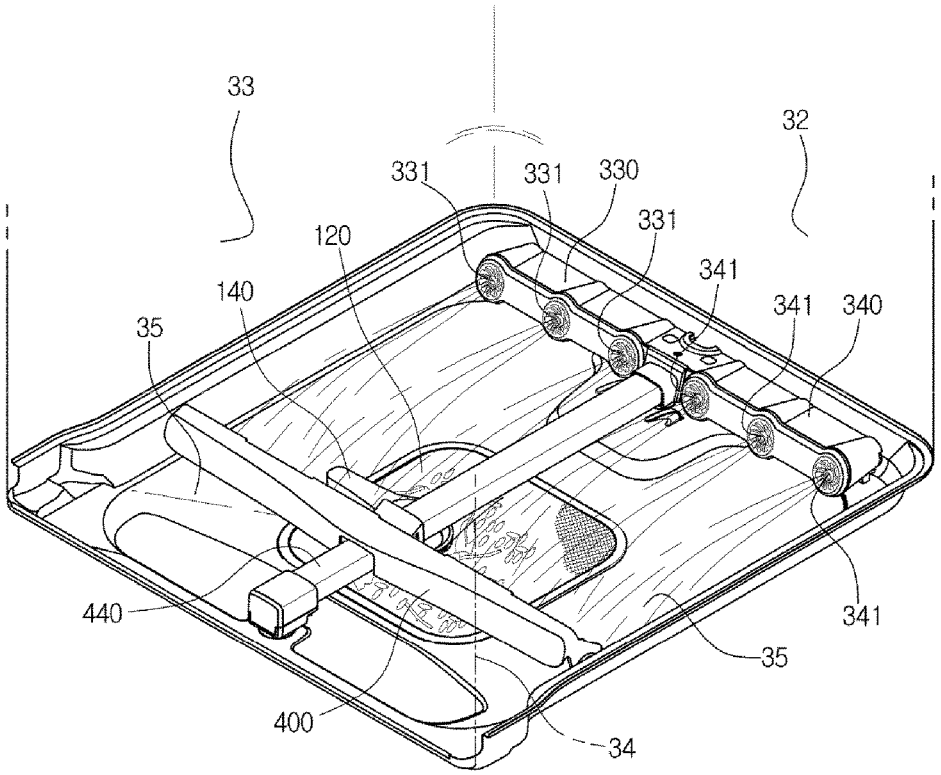
Figure 13J:
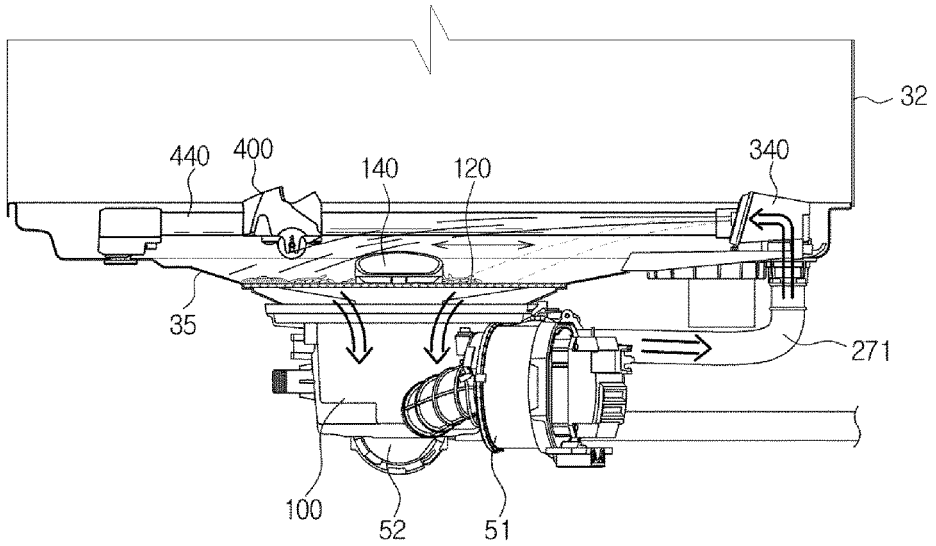

When the supply of the third water supply amount of washing water is completed, the controller 720 may drive the circulation pump 51 at a sixth speed (about 1000 to 1100 RPM) for a sixth time (a time necessary for removing a blockage of a filter by directly jetting washing water jetted from a nozzle onto the top of the filter, about 90 seconds) such that washing water jetted from the lower nozzles 330 and 340 is jetted toward the filters 120, 130, and 140 on top of the sump 100 as shown in FIGS. 13I and 13J.

Here, when the third water supply amount is smaller than the second water supply amount, a sixth RPM is provided to be lower than the fifth RPM. On the other hand, when the third water supply amount is greater than the second water supply amount, the sixth RPM is provided to be higher than the fifth RPM such that the RPM of the circulation pump 51 may vary according to a water supply amount.

After the sixth time passes, the controller 720 stops jetting the washing water by stopping the driving of the circulation pump 51 using the driver 740. Through the direct jetting operation of washing water described above, a second filter washing operation in which a considerable amount of foreign material accumulated on top of the fine filter 120 is moved to the coarse filter 140 to remove blockages on top of the filters 120, 130, and 140 is performed.

The controller 720 performs a third draining operation of completely draining foreign material which remains at the sump 100 and washing water by driving the drain pump 52 using the driver 740.

Figure 13K:
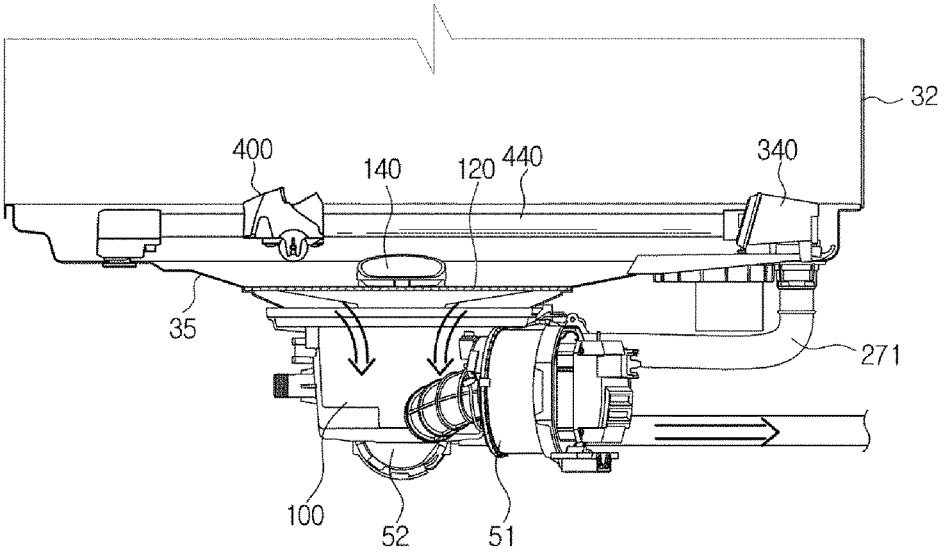

Referring to FIG. 13K, the third draining operation may provide an effect of tertiarily removing the blockage of the micro filter 130 through a draining operation of discharging foreign material collected at the foreign material collecting chamber 111 and washing water from the body 10 to the outside.

After the third draining operation is finished, the filter blockage removal operation may be completed and the controller 720 may drive the motor 530 using the driver 740 and move the vane 400 to the reference position.

Meanwhile, the filter blockage removal operation performed by the dish washing machine 1 is not limited to the example described above and may be performed using various algorithms in addition thereto.

When the filter blockage removal operation is finished, the controller 720 may determine whether a pump failure is detected again. When the filter blockage removal operation is finished and the change in power consumption of the circulation pump 51 is reduced to be less than the reference value, a failure of the circulation pump 51 may be determined to be fixed, circulation of washing water is normally performed, and a previous operation which was stopped may be resumed.

When restarting the previous operation, the previous operation may be performed from the beginning without considering progress of a stop time. As an example, when the previous operation is the washing operation which is performed at a time at which a pump failure is detected, the washing operation may be performed from the beginning.

Otherwise, an operation may be resumed from the stop time in consideration of the progress of the stop time. For this, the progress of the stop time may be stored in the memory 730.

When a change in power consumption is still detected as the reference value or more although the filter blockage removal operation is finished, the controller 720 determines a water shortage situation and performs water supplementation.

The water supplementation may be performed in various ways. As an example, a method of draining all of the washing water in the washing tub 30 and re-supplying washing water may be employed. As another example, a method of additionally supplying a certain amount of washing water may be employed. As another example, a method of additionally supplying the certain amount of washing water in stages may be employed.

When a water supplementation operation is finished, the controller 720 may determine whether a pump failure is detected again. When the water supplementation operation is finished and then the change in power consumption of the circulation pump 51 is reduced to be less than the reference value, circulation of washing water may be determined to be normally performed and a previous operation which was stopped may be restarted.

However, when a change in power consumption is the reference value or more although the water supplementation is finished, the controller 720 may visually output a failure warning through the display 750. Also, when the dish washing machine 1 includes a speaker, it is also possible to acoustically output a warning through the speaker.

Meanwhile, even though the change in power consumption detected after the water supplementation is finished is the reference value or more, it is possible to output a failure warning after performing the water supplementation operation several times instead of directly outputting the failure warning. For example, when a change in power consumption is the reference value or more after the certain amount of washing water is additionally supplied, the water supplementation may be retried by additionally supplying the certain amount of washing water again.

The maximum number of retries may be predetermined through experiments, simulations, or the like. However, when the change in power consumption is reduced to be less than the reference value before the maximum number of retries is reached, the water supplementation is not additionally performed.

As described above, when circulation of washing water is not normally performed, it is possible to cope actively with a failure in the circulation of washing water by sequentially or selectively performing the bubble removal operation, the filter blockage removal operation, and the water supplementation operation.

Meanwhile, in the above example, the bubble removal operation, the filter blockage removal operation, and the water supplementation operation have been described as being sequentially performed. However, embodiments of the dish washing machine 1 are not limited to the above order. For example, it is possible to perform the filter blockage removal operation first, and it is also possible to perform the water supplementation operation first.

Hereinafter, embodiments of a method of controlling a dish washing machine will be described. The dish washing machine 1 in accordance with the previous embodiment of the present disclosure may be applied to the method of controlling a dish washing machine.

Accordingly, the above description of the dish washing machine 1 may be applied to the method of controlling a dish washing machine.

Figure 14:
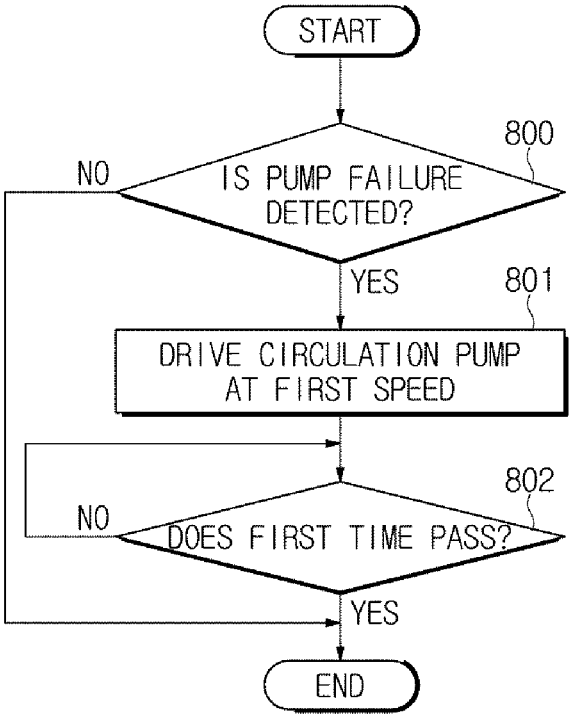
FIG. 14 is a flowchart illustrating an example of a bubble removal operation in a method of controlling a dish washing machine in accordance with one embodiment.

FIG. 14 is a flowchart illustrating an example of a bubble removal operation in a method of controlling a dish washing machine in accordance with one embodiment.

While performing operations such as preliminary washing, main washing, rinsing, and the like among operations of the dish washing machine 1, it is possible to check for a change in the power consumption of the circulation pump 51 by monitoring the power consumption. When the change in power consumption is as great as the preset reference value or more, a pump failure is determined to be detected (YES in 800) and an operation which is being performed at a time at which the pump failure is detected is stopped.

The controller 720 may determine that a cause of the pump failure is bubbles at the bottom of the washing tub 30 and may perform a bubble removal operation. As an example of the bubble removal operation, the circulation pump 51 may be driven at the first speed (801).

This is for removing the bubbles by directly jetting washing water onto bubbles at the bottom of the washing tub 30. When washing water is jetted through the intermediate nozzle 313, the jetted washing water may hit the bubbles while falling toward the bottom plate 35, and the bubbles may be removed by being hit by the washing water.

Also, the controller 720 may control a flow rate of washing water to be supplied to the nozzle by controlling the RPM of the circulation pump 51 to be the first speed. As an example, a phenomenon in which bubbles are increased by jetting washing water may be prevented by controlling the RPM of the circulation pump 51 to be a level (about 1400 RPM to 1600 RPM) lower than a speed applied to a washing operation or a rinsing operation such that washing water jetted toward the top of the washing tub 30 from the intermediate nozzle 313 falls before arriving at the bottom of the upper basket 12*a*. Also, the first speed may be an RPM which may rotate the intermediate nozzle 313 by the jetting of washing water.

Meanwhile, the controller 720 may perform the bubble removal operation for the first time. That is, the RPM of the circulation pump 51 may be controlled to be the first speed for the first time. Accordingly, the controller 720 may count a driving time of the circulation pump 51 using the timer 770, may drive the circulation pump 51 at the first speed when the first time does not pass (NO in 802), and may finish the bubble removal operation when the first time passes (YES in 802).

Figure 15:
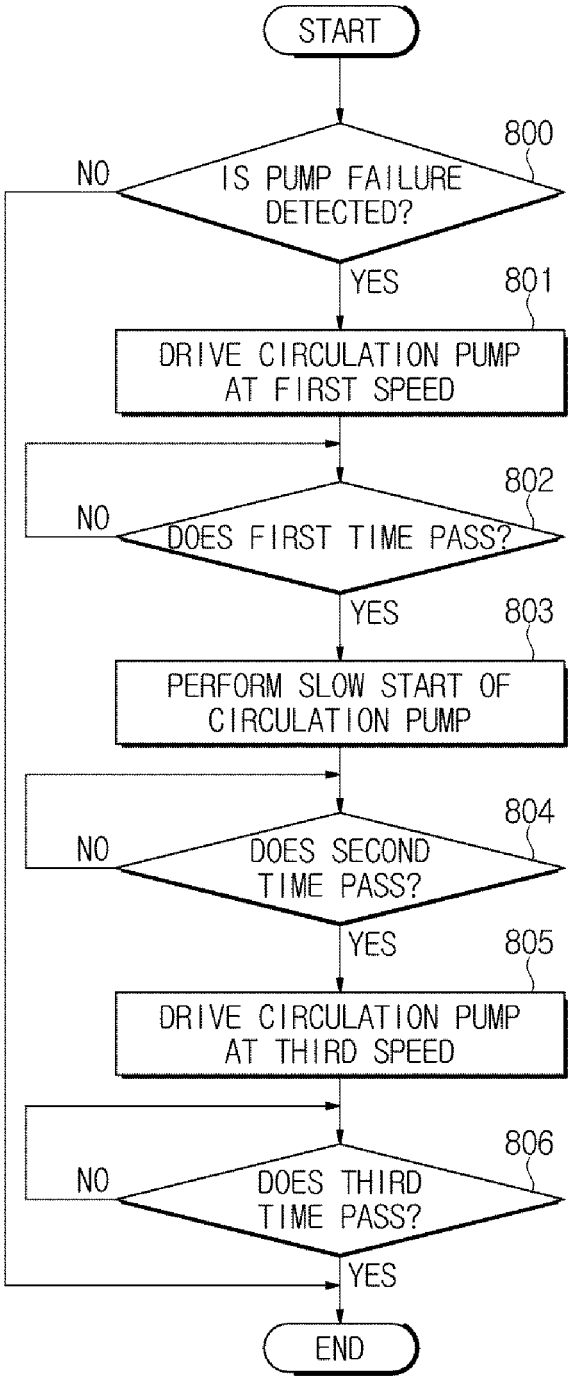
FIG. 15 is a flowchart illustrating another example of the bubble removal operation in the method of controlling a dish washing machine in accordance with one embodiment.

FIG. 15 is a flowchart illustrating another example of the bubble removal operation in the method of controlling a dish washing machine in accordance with one embodiment.

A process in which a pump failure is detected based on a change in power consumption of the circulation pump 51 (800) and the circulation pump 51 is driven at the first speed for the first time (801 and 802) is identical to the example described above.

In the present example, the bubble removal operation is not directly finished after the circulation pump 51 is driven at the first speed for the first time, and an operation of washing bubbles may be additionally performed to address a possibility in which the bubbles remain in spite of the direct jetting of the washing water.

In detail, when the first time passes after the circulation pump 51 is driven at the first speed (YES in 802), a slow start of the circulation pump 51 is performed (803). As an example, when the circulation pump 51 is slowly driven at the second speed (about 1600 RPM to 3000 RPM), bubbles which are not removed by being hit by the washing water and remain at the bottom may be prevented from rapidly moving upward.

The slow start of the circulation pump 51 may be performed for the second time, and the second time may be set to about 1 minute.

When the second time passes after the slow start of the circulation pump 51 is performed (YES in 804), the controller 720 may drive the circulation pump 51 at the third speed (805). Here, the controller 720 may control the distribution device 200 to jet washing water through the upper nozzle 311 and the intermediate nozzle 313. The third speed may be set in consideration of a water pressure necessary for washing the bubbles which remain at the bottom of the washing tub 30, and for example, may be set within a range of about 3000 RPM to 3400 RPM.

When the third time passes (YES in 806), the bubble removal operation may be finished. The third time may be set as an appropriate time necessary for washing the bubbles at the bottom of the washing tub 30 and may be set to about 1 minute.

Also, after the third time passes, the bubble removal operation may not be directly finished, and may be possible to wash the bubbles which remain at the bottom of the washing tub 30 by controlling washing water to be jetted through the lower nozzles 330 and 340 once more.

Also, as another example, when the bubble removal operation starts, the circulation pump 51 may not be driven and may stand by until bubbles subside to the bottom of the washing tub 30. In this case, an operation of driving the circulation pump 51 at the second speed for the second time to be slow started is identical to the example described above.

Figure 16:
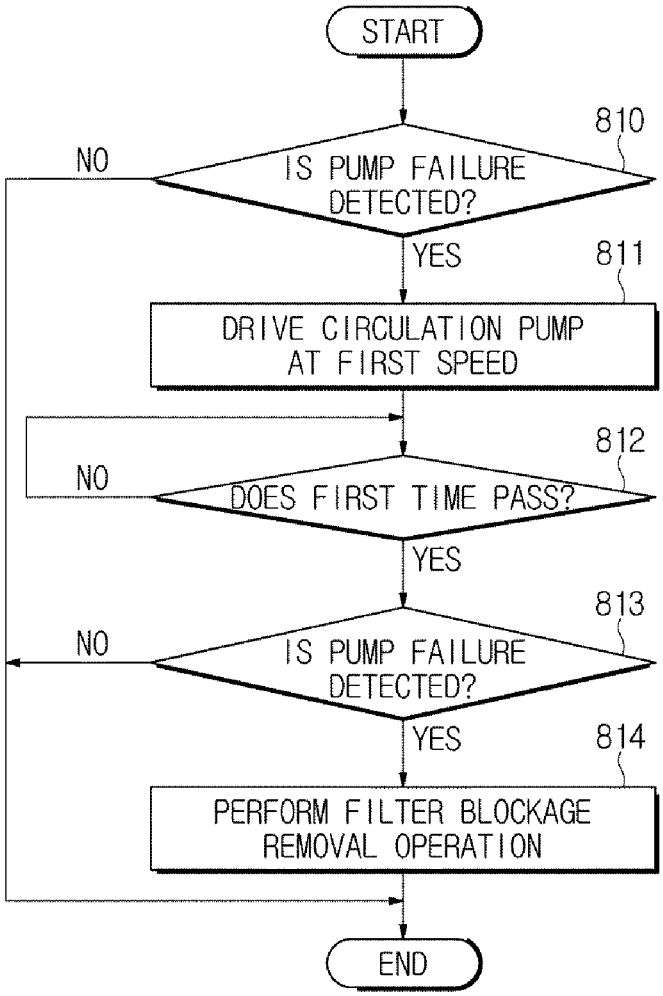
FIG. 16 is a flowchart illustrating another example of a method of fixing a failure of a circulation pump in the method of controlling a dish washing machine in accordance with one embodiment.

FIG. 16 is a flowchart illustrating another example of a method of fixing a failure of a circulation pump in the method of controlling a dish washing machine in accordance with one embodiment.

When a change in power consumption is as great as the preset reference value or more, a pump failure is determined to be detected (YES in 810) and an operation which is being performed is stopped.

The controller 720 may determine that a cause of the pump failure is bubbles at the bottom of the washing tub 30 and may perform a bubble removal operation. As an example of the bubble removal operation, the circulation pump 51 may be driven at the first speed (811).

When the first time passes (YES in 812), whether a pump failure is detected is determined by checking for a change in power consumption (813). When the change in power consumption is reduced to be less than the reference value, the pump failure is determined to not be detected (NO in 813) and a process for fixing the pump failure is finished. Also, since a previous operation which was stopped is resumed, the previous operation may be performed from the beginning or may be resumed without repeating a process performed before a stop time at which information on operation progress at the stop time is stored.

When the change in power consumption is still the reference value or more, the pump failure is determined to be detected (YES in 813) and a filter blockage is included in a cause of a washing water circulation failure. Accordingly, a filter blockage removal operation is performed (814).

Figure 17A:
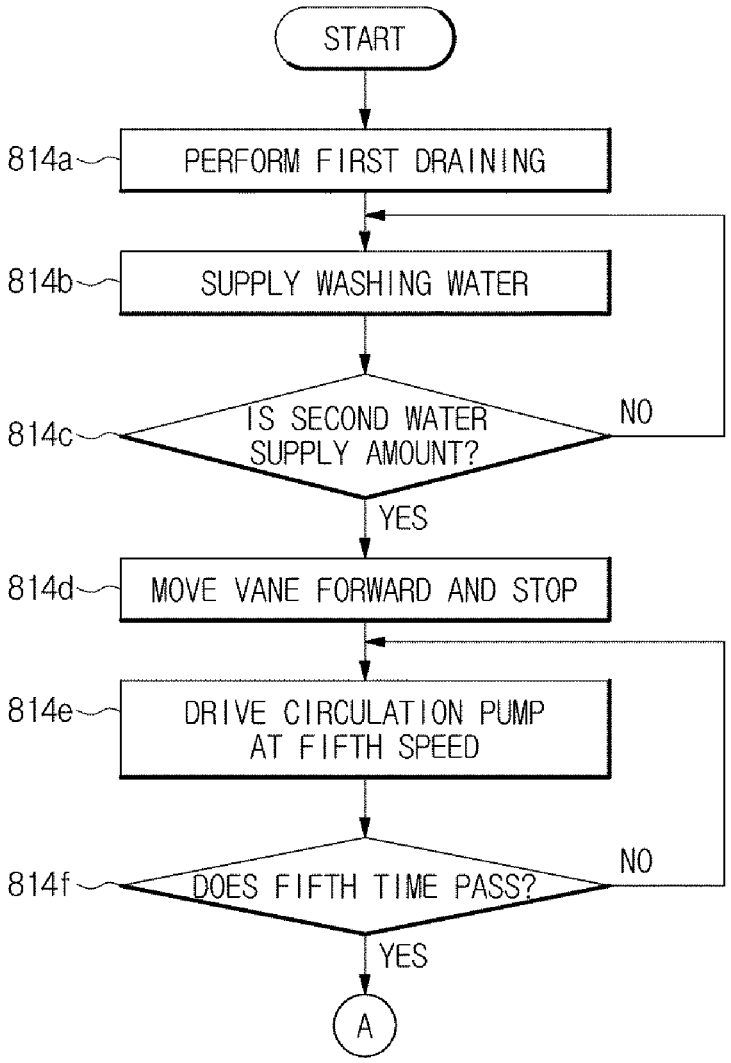
FIGS. 17A and 17B are flowcharts illustrating one example of a filter blockage removal operation in the method of controlling a dish washing machine in accordance with one embodiment.
Figure 17B:
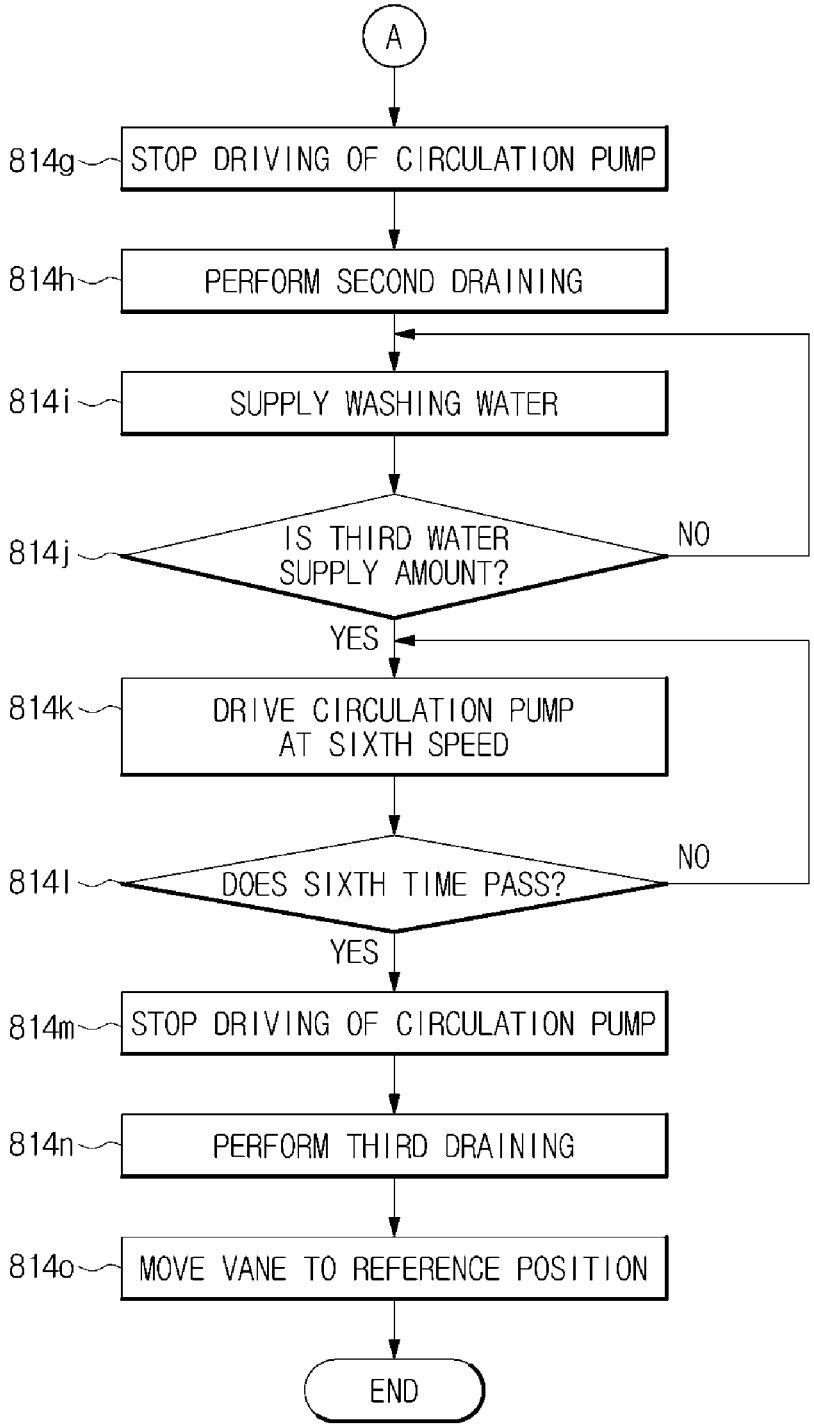

FIGS. 17A and 17B are flowcharts illustrating one example of a filter blockage removal operation in the method of controlling a dish washing machine in accordance with one embodiment.

Referring to FIGS. 17A and 17B, the controller 720 may perform a first draining operation of completely draining foreign material which remains at the sump 100 and washing water by driving the drain pump 52 using the driver 740 (814*a*).

The first draining operation may provide an effect of primarily removing a blockage of the micro filter 130 through a draining operation of discharging foreign material collected at the foreign material collecting chamber 111 and washing water from the body 10 to the outside.

After the first draining operation, the controller 720 may stop driving the drain pump 52 using the driver 740 and may supply washing water for removing blockages of the filters 120, 130, and 140 by driving the water supply valve 49 (814*b*).

When the washing water for removing the blockages of the filters 120, 130, and 140 is supplied, a flow amount of washing water to be supplied into the washing tub 30 may be adjusted to be the second water supply amount (a small amount of washing water capable of filling the inside of the sump, about 700 to 900 cc).

When the supply of the second water supply amount of washing water is complete (YES in 814*c*), the controller 720 moves the vane 400 forward from a reference position for a certain time (about 7 seconds) using the driver 740 and then stops (814*d*).

After the vane 400 is moved forward, the controller 720 may drive the circulation pump 51 at the fifth speed (about 1200 to 1400 RPM) (814*e*) such that washing water jetted from the lower nozzles 330 and 340 is jetted toward the filters 120, 130, and 140 on top of the sump 100.

The controller 720 may count a driving time based on the timer 770 and may continuously drive the circulation pump 51 at the fifth speed when the fifth time does not pass (NO in 814*f*).

The fifth time may be set in consideration of a time necessary for moving foreign material accumulated on top of the filters to the foreign material collecting chamber by jetting washing water, and may be set, for example, to about 30 seconds.

After the fifth time passes (YES in 814*f*), the controller 720 stops jetting the washing water by stopping the driving of the circulation pump 51 using the driver 740 (814*g*). Through the operation of jetting washing water, a first filter washing operation in which some of the foreign material accumulated on top of the filters 120, 130, and 140 is moved to the foreign substance collecting chamber 111 to remove the blockages of the filters 120, 130, and 140 to some degree is performed.

Then, the controller 720 performs a second draining operation of draining foreign material which remains at the sump 100 and washing water for a certain time (about 30 seconds) by driving the drain pump 52 using the driver 740 (814*h*).

The second draining operation may provide an effect of secondarily removing the blockage of the micro filter 130 by discharging foreign material collected at the foreign material collecting chamber 111 and washing water from the body 10 to the outside.

After the second draining operation, the controller 720 stops driving the drain pump 52 using the driver 740 and supplies washing water for removing the blockages of the filters 120, 130, and 140 by driving the water supply valve 49 (814*i*).

A flow rate of washing water to be supplied into the washing tub 30 is detected by the flowmeter 705, and the supply of washing water continues until the third water supply amount (a small amount of washing water capable of filling the inside of the sump, about 700 cc) is reached. The third water supply amount may be smaller than the second water supply amount.

When the supply of the third water supply amount of washing water is completed (YES in 814*j*), the controller 720 may drive the circulation pump 51 at the sixth speed (about 1000 to 1100 RPM) for the sixth time (a time necessary for removing the blockage of the filter by directly jetting washing water jetted from a nozzle onto the top of the filter, about 90 seconds) such that the washing water jetted from the lower nozzles 330 and 340 is jetted toward the filters 120, 130, and 140 on top of the sump 100 (814*k*, NO in 814*l*).

Here, when the third water supply amount is smaller than the second water supply amount, the sixth speed is provided to be lower than the fifth speed. On the other hand, when the third water supply amount is greater than the second water supply amount, the sixth speed may be provided to be higher than the fifth speed such that the RPM of the circulation pump 51 may vary according to a water supply amount.

After the sixth time passes (YES in 814*l*), the controller 720 stops jetting the washing water by stopping the driving of the circulation pump 51 using the driver 740 (814*m*). Through the direct jetting operation of washing water described above, a second filter washing operation in which a considerable amount of foreign material accumulated on top of the fine filter 120 is moved to the coarse filter 140 to remove blockages on top of the filters 120, 130, and 140 is performed.

The controller 720 performs a third draining operation of completely draining foreign material which remains at the sump 100 and washing water by driving the drain pump 52 using the driver 740 (814*n*).

The third draining operation may provide an effect of tertiarily removing the blockage of the micro filter 130 through a draining operation of discharging foreign material collected at the foreign material collecting chamber 111 and washing water to the outside from the body 10.

After the third draining operation is finished, the filter blockage removal operation may be completed and the controller 720 may move the vane 400 to the reference position by driving the motor 530 using the driver 740 (8140).

Figure 18:
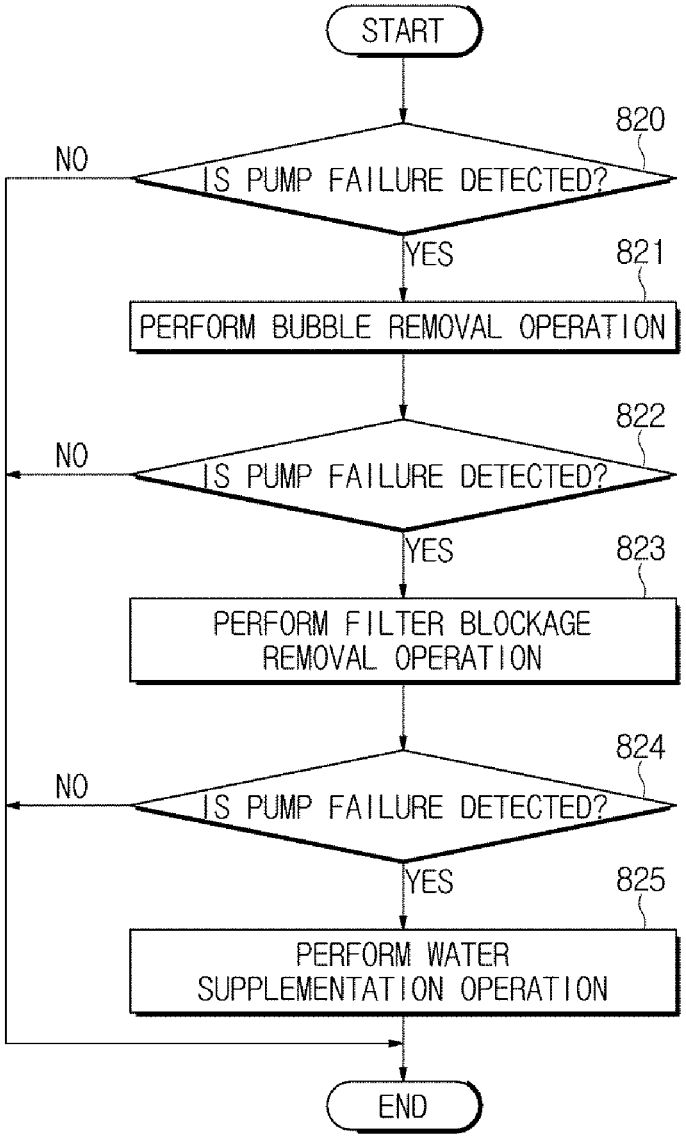
FIG. 18 is a flowchart illustrating still another example of a method of fixing a pump failure in the method of controlling a dish washing machine in accordance with one embodiment.

FIG. 18 is a flowchart illustrating still another example of a method of fixing a pump failure in the method of controlling a dish washing machine in accordance with one embodiment.

When a pump failure is detected (YES in 820), a bubble removal operation is performed (821). Here, an operation which is originally being performed may be stopped. The bubble removal operation may be performed according to the example in FIG. 14 or 15 described above. Otherwise, in the example in FIG. 15, the circulation pump 51 is not driven at the first speed but is stopped such that washing water is not directly jetted to remove bubbles and the bubbles are washed using the washing water after subsiding to the bottom of the washing tub 30.

When the pump failure is still detected after the bubble removal operation is performed (YES in 822), the controller 720 determines that a filter blockage is included in a cause of generating a washing water circulation failure and performs a filter blockage removal operation (823). The filter blockage removal operation may be performed according to an algorithm of FIGS. 17A and 17B described above, and may be performed according to another algorithm in addition thereto.

When the pump failure is still detected after the filter blockage removal operation is performed (YES in 824), the controller 720 determines that a water shortage is included in a cause of the pump failure and performs a water supplementation operation (825).

The water supplementation may be performed in various ways. As an example, a method of draining all of the washing water in the washing tub 30 and supplying washing water again may be employed. As another example, a method of additionally supplying a certain amount of washing water may be employed. As another example, a method of additionally supplying the certain amount of washing water in stages may be employed.

When a change in power consumption of the circulation pump 51 is reduced to be less than the reference value and a pump failure is not detected after the bubble removal operation and the filter blockage removal operation are performed (NO in 822 and NO in 824), an operation which was stopped at a time at which the pump failure is detected may be resumed. Here, it is possible to perform the operation again from the beginning without considering a progress of a stop time or to resume the operation from the stop time in consideration of the progress of the stop time.

As the example of FIG. 18, when the washing water circulation failure is still detected although the filter blockage removal operation is performed, the water supplementation operation may be additionally performed to cope with various situations which cause the washing water circulation failure.

Meanwhile, when the washing water circulation failure is detected even after the water supplementation is performed, an error warning may be output. This will be described below with reference to FIG. 19.

Figure 19:
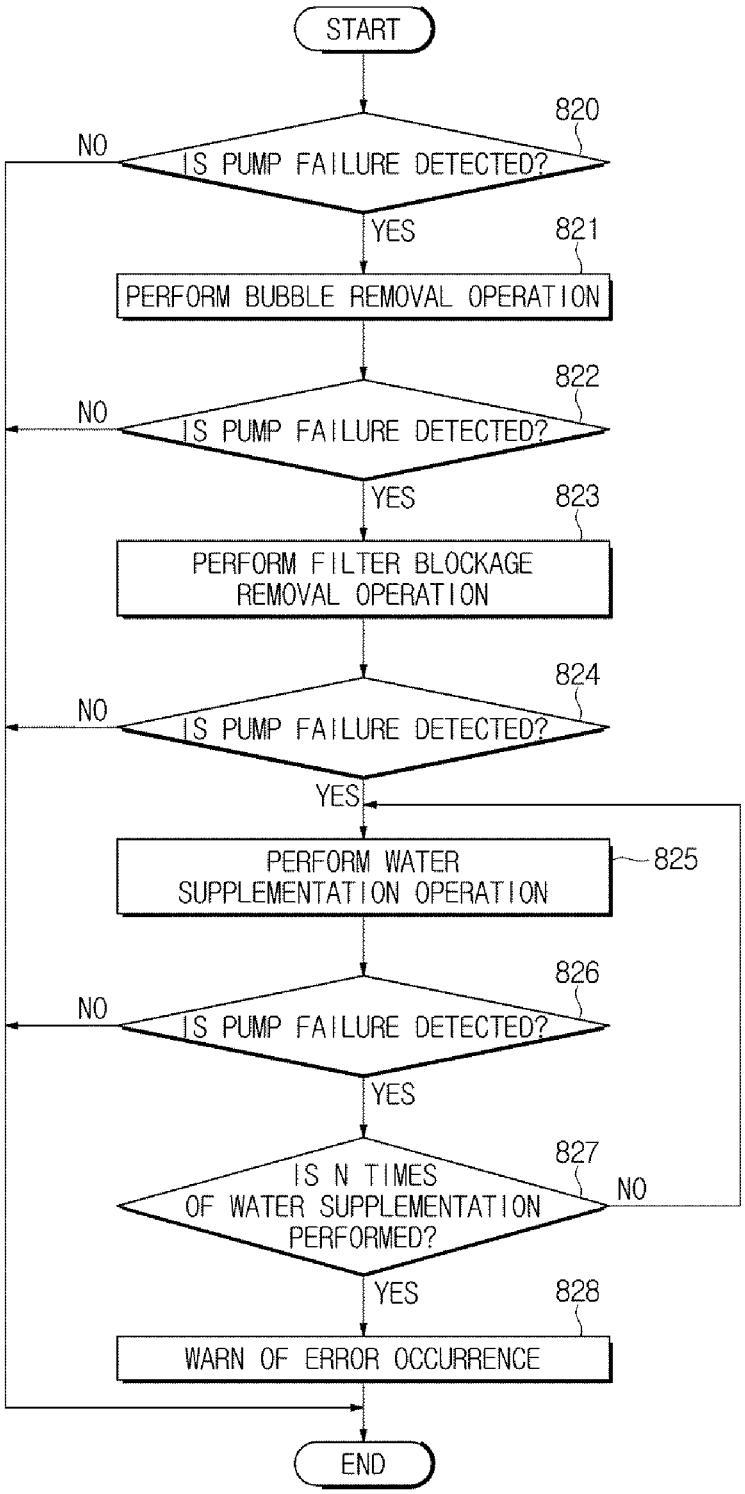
FIG. 19 is a flowchart illustrating an example of outputting an error warning in the method of controlling a dish washing machine in accordance with one embodiment.

FIG. 19 is a flowchart illustrating an example of outputting an error warning in the method of controlling a dish washing machine in accordance with one embodiment.

Referring to FIG. 19, the operations of detecting the pump failure (820), performing the bubble removal operation (821), detecting the pump failure (822), performing the filter blockage removal operation (823), detecting the pump failure (824), and performing the water supplementation operation (825) are identical to the example of FIG. 18 described above.

Like the above description, when a change in power consumption of the circulation pump 51 is reduced to be less than the reference value and a pump failure is not detected after the bubble removal operation and the filter blockage removal operation are performed (NO in 822 and NO in 824), an operation which is stopped may be resumed.

Also, after the water supplementation operation is performed, whether a pump failure is detected may be determined and additional water supplementation may be performed when a pump failure is detected (YES in 826). Since a number n (n indicates an integer of 1 or more) is the maximum number of times the water supplementation may be performed, the water supplementation operation may be repeatedly performed (825) when the pump failure is detected until the number of times the water supplementation is performed is the number n (NO in 827).

When the pump failure is detected although the number of times the water supplementation is performed is the number n (YES in 827), an error occurrence warning is output (828). The error occurrence warning may be visually or acoustically output.

Meanwhile, the bubble removal operation, the filter blockage removal operation, and the water supplementation operation are described as being sequentially performed in the example described above for convenience of description. However, the method of controlling a dish washing machine is not limited thereto. For example, the filter blockage removal operation or the water supplementation operation may be performed first.

As should be apparent from the above description, a dish washing machine and a method of controlling the same in accordance with one embodiment of the present disclosure may actively respond when circulation of washing water is not smoothly performed by sequentially and selectively performing the bubble removal operation, the filter blockage removal operation, and the water supply operation.

Also, even though additional apparatuses for sensing an occurrence of bubbles, a filter blockage, and a water shortage are not provided, it is possible to sense the occurrence of bubbles, the filter blockage, and the water shortage by only using a change in power consumption of the circulation pump.

Also, a dish washing machine not only simply stops the circulation pump and stands by while removing bubbles but is also able to reduce time used for removing the bubbles by directly jetting washing water onto surfaces of bubbles.

Although a few embodiments of the present disclosure have been shown and described, those skilled in the art should appreciated that changes may be made in these embodiments without departing from the principle and spirit of the present disclosure, the scope of which is defined in the claims and their equivalents.

What is claimed is:

1. A dish washing machine comprising:

a washing tub;

a sump installed at a bottom of the washing tub and configured to store washing water;

a circulation pump configured to pump and circulate the washing water stored in the sump;

at least one nozzle configured to jet the washing water pumped by the circulation pump into the washing tub;

a filter configured to filter foreign material included in the washing water;

a detector configured to detect a failure of the circulation pump; and a controller configured to perform:

a bubble removal operation for removing bubbles generated in the washing tub, as a first operation when the failure of the circulation pump is detected, a filter blockage removal operation for removing a blockage of the filter as a second operation when the failure of the circulation pump is detected even after the first operation is finished, and a water supplementation operation for additionally supplying water to the washing tub as a third operation when the failure of the circulation pump is detected even after the second operation is finished.

2. The dish washing machine of claim 1, wherein the detector determines that the failure occurs at the circulation pump when a change in power consumption of the circulation pump is detected to be a preset reference value or more.

3. The dish washing machine of claim 1, wherein the controller controls revolutions per minute (RPM) of the circulation pump to be a first speed and jets the washing water onto the bubbles through the nozzle to perform the bubble removal operation.

4. The dish washing machine of claim 3, wherein the first speed is less than a speed at which the washing water jetted from the nozzle arrives at an upper basket disposed above the nozzle, and is a minimum speed for rotating the nozzle or more.

5. The dish washing machine of claim 4, wherein the nozzle is an intermediate nozzle positioned between the upper basket and a lower basket disposed at a lower part of the washing tub, and wherein the intermediate nozzle jets the washing water onto bubbles positioned at the bottom of the washing tub.

6. The dish washing machine of claim 3, wherein the first speed is selected within a range of 1400 RPM to 1600 RPM.

7. The dish washing machine of claim 1, wherein the controller stops rotation of the circulation pump to perform the bubble removal operation.

8. The dish washing machine of claim 7, wherein the at least one nozzle comprises:

an intermediate nozzle positioned between an upper basket disposed at an upper part of the washing tub and a lower basket disposed at a lower part of the washing tub; and a lower nozzle positioned below the lower basket.

9. The dish washing machine of claim 8, wherein the controller slow starts the circulation pump when a preset time passes after the rotation of the circulation pump is stopped.

10. The dish washing machine of claim 9, wherein the controller controls the intermediate nozzle and the lower nozzle to sequentially jet the washing water after slow starting the circulation pump.

11. The dish washing machine of claim 1, further comprising a water supply valve configured to adjust an amount of washing water supplied into the washing tub.

12. The dish washing machine of claim 10, wherein the controller adds a preset amount of washing water to the washing tub by controlling the water supply valve to perform the water supplementation operation.

13. The dish washing machine of claim 10, wherein the controller drains all washing water filled into the washing tub and supplies a preset amount of washing water to the washing tub by controlling the water supply valve to perform the water supplementation operation.

14. The dish washing machine of claim 2, wherein the controller performs the bubble removal operation as the first operation, performs the filter blockage removal operation as the second operation, and performs the water supplementation operation as the third operation.

15. The dish washing machine of claim 14, wherein the controller performs the water supplementation operation again when the failure of the circulation pump is detected even after the water supplementation operation is finished.

* * * * *